US008896490B2

(12) United States Patent
Miki et al.

(10) Patent No.: US 8,896,490 B2
(45) Date of Patent: Nov. 25, 2014

(54) THREE-AXIS ANTENNA AND CORE ASSEMBLY USED THEREIN

(75) Inventors: Hirohiko Miki, Tottori (JP); Masaki Nakamura, Tottori (JP); Tadashi Kodani, Tottori (JP); Fumiko Akano, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 234 days.

(21) Appl. No.: 13/640,405

(22) PCT Filed: Apr. 12, 2011

(86) PCT No.: PCT/JP2011/059120

§ 371 (c)(1),
(2), (4) Date: Oct. 10, 2012

(87) PCT Pub. No.: WO2011/129347

PCT Pub. Date: Oct. 20, 2011

(65) Prior Publication Data

US 2013/0033408 A1 Feb. 7, 2013

(30) Foreign Application Priority Data

Apr. 13, 2010 (JP) ..... 2010-092243

(51) Int. Cl.

| | |
|---|---|
| ***H01Q 7/06*** | (2006.01) |
| ***H01Q 21/24*** | (2006.01) |
| ***H01Q 1/32*** | (2006.01) |
| ***H01Q 25/00*** | (2006.01) |

(52) U.S. Cl.

CPC ..... *H01Q 1/3241* (2013.01); *H01Q 21/24* (2013.01); *H01Q 7/06* (2013.01); *H01Q 25/00* (2013.01)

USPC ..... 343/788

(58) Field of Classification Search

CPC ..... H01Q 7/06; H01Q 1/3241

USPC ..... 343/788

See application file for complete search history.

(56) References Cited

U.S. PATENT DOCUMENTS

| | | | | |
|---|---|---|---|---|
| 7,755,558 | B2 * | 7/2010 | Ueda et al. | 343/788 |
| 7,796,091 | B2 * | 9/2010 | Ueda | 343/788 |

(Continued)

FOREIGN PATENT DOCUMENTS

| | | | |
|---|---|---|---|
| JP | 2003-92509 | A | 3/2003 |
| JP | 2004-15168 | A | 1/2004 |
| JP | 2006-157295 | A | 6/2006 |
| JP | 2007-151154 | A | 6/2007 |

OTHER PUBLICATIONS

International Search Report for PCT/JP2011/059120 dated Jul. 19, 2011.

*Primary Examiner* — Hoang V Nguyen
(74) *Attorney, Agent, or Firm* — Sughrue Mion, PLLC

(57) ABSTRACT

A core assembly comprising first and second core members each having a rectangular body around which an X-axis coil and a Y-axis coil are wound, and flanges integrally and diagonally extending from the body; and a bobbin having an annular portion and projections diagonally extending therefrom; the projections of the bobbin being provided with terminal members connected to coil ends of the X-axis coil, the Y-axis coil and the Z-axis; the annular portion of the bobbin acting as a space for disposing the first core member from one side, and providing a space receiving at least partially the body of the second core member from the other side, such that the body of the first core member is at least partially adjacent to the body of the second core member; and a space for winding the Z-axis coil being provided between the projections of the bobbin and the flanges of the second core member.

9 Claims, 29 Drawing Sheets

(56) References Cited

U.S. PATENT DOCUMENTS

2003/0222829 A1 12/2003 Kitahara et al.
2004/0061660 A1 4/2004 Yoshida et al.
2006/0114162 A1 6/2006 Minami et al.
2006/0152427 A1 7/2006 Ueda et al.
2008/0036672 A1 2/2008 Ueda et al.

* cited by examiner

THREE-AXIS ANTENNA AND CORE ASSEMBLY USED THEREIN

CROSS REFERENCE TO RELATED APPLICATIONS

This application is a National Stage of International Application No. PCT/JP2011/059120 filed Apr. 12, 2011, claiming priority based on Japanese Patent Application No. 2010-092243 filed Apr. 13, 2010, the contents of all of which are incorporated herein by reference in their entirety.

FIELD OF THE INVENTION

The present invention relates to a three-axis antenna contained in door keys of automobiles, etc., and a core assembly used therein.

BACKGROUND OF THE INVENTION

Wireless electronic keys have been getting widely used as door keys of automobiles and houses, engine start keys, etc. For example, in the case of electronic keys for doors, electronic authentication keys carried by humans receive low-frequency request signals from door key apparatuses, and transmit response signals at UHF (ultra-high frequency), so that the door key apparatuses receiving the UHF signals conduct the authentication of IDs. In immobilizers conducting the authentication of engine start, etc., the authentication of Ids is conducted by LF (low frequency) communications. Low frequencies used for transmitting and receiving signals of such electronic keys include not only LF (low frequency), but also VLF (very low frequency) and MF (middle frequency).

Low-frequency-signal-receiving antennas contained in electronic keys for authentication are mainly antennas having coils wound around soft magnetic cores, which exhibit insufficient performance of transmission and receiving depending on the direction because of their directivity. To efficiently detect electromagnetic waves in any three-dimensional directions with reduced directivity, three-axis antennas comprising an X-axis coil, a Y-axis coil and a Z-axis coil in combination are used for electronic keys for authentication.

JP 2004-015168 A discloses, as shown in FIGS. 24(*a*)-24(*d*), a non-directional receiving antenna comprising a disc-shaped, soft magnetic core 300 having first to third grooves 301, 302, 303, and an X-axis coil 311, a Y-axis coil 312 and a Z-axis coil 313 successively wound around the first to third grooves 301, 302, 303. JP 2004-015168 A also discloses, as shown in FIGS. 24(*e*) and 24(*f*), a core comprising a disc-shaped, soft magnetic core piece 330 having first and second grooves 331, 332 around which an X-axis coil and a Y-axis coil are wound, and a ring-shaped, soft magnetic core piece 340 having a third groove 343 around which a Z-axis coil is wound. Because these cores are formed by one or two core pieces, they can be easily miniaturized with a reduced number of parts. However, because the integral, disc-shaped, soft magnetic core 300 shown in FIGS. 24(*a*) to 24(*d*) has a complicated shape with grooves extending in three directions, it cannot be produced by pressing. This is true of the combined cores shown in FIGS. 24(*e*) and 24(*f*). In addition, the receiving antenna of JP 2004-015168 A having no bobbin fails to be integrally provided with terminal members. The direct bonding of terminal members to the core fails to achieve sufficient adhesion strength, and the core may be broken under stress.

JP 2007-151154 A discloses, as shown in FIG. 25, a three-axis antenna comprising a cruciform casing 400, a pair of core pieces 421, 422 disposed in a cruciform recess 410 of the casing 400, a pair of X-axis coils 431 wound around one core piece 421, a pair of Y-axis coils 432 wound around the other core piece 422, and a Z-axis coil 433 wound around the cruciform casing 400. However, because this three-axis antenna has a structure in which both core pieces 421, 422 are contained in the cruciform casing 400, a core piece volume per the installation area of the antenna cannot be sufficiently large, resulting in insufficient receiving sensitivity. Also, because the core piece 421 around which the X-axis coil 431 is wound and the core piece 422 around which the Y-axis coil 432 is wound are overlapping each other in the cruciform casing 400, this three-axis antenna cannot be made thinner.

OBJECT OF THE INVENTION

Accordingly, an object of the present invention is to provide a thin, three-axis antenna having high receiving sensitivity in a small installation area, which can be inexpensively produced because of using press-moldable cores, and a core assembly used therein.

DISCLOSURE OF THE INVENTION

The core assembly for a three-axis antenna according to the present invention comprises a first core member comprising a body around which an X-axis coil and a Y-axis coil are wound, and flanges integrally and diagonally extending from the body;

a second core member comprising a body around which an X-axis coil and a Y-axis coil are wound, and flanges integrally and diagonally extending from the body; and a bobbin comprising an annular portion and projections integrally and diagonally extending therefrom;

the projections of the bobbin being provided with terminal members connected to the ends of the X-axis coil, the Y-axis coil and the Z-axis coil;

the annular portion of the bobbin functioning as a space for disposing the first core member from one side, and receiving at least part of the body of the second core member from the other side, such that the body of the first core member and the body of the second core member are at least partially adjacent to each other; and a space for winding the Z-axis coil being provided between the projections of the bobbin and the flanges of the first or second core member.

The first core member is preferably in the form of a flat plate, and the second core member preferably has a thicker body than flanges.

The terminal members provided on the projections of the bobbin are preferably positioned such that they do not overlap the X-axis coil and the Y-axis coil in a Z direction.

It is preferable that the first core member is in the form of a thin flat plate having a rectangular body and flanges integrally and diagonally extending from the body;

that the second core member has a thicker rectangular body than the first core member, and thin rectangular flanges integrally and diagonally extending from the body; and that the bobbin comprises an annular portion which is rectangular at least in a center portion, and rectangular projections integrally and diagonally extending from corners of the annular portion.

The term "rectangular" used herein is not restricted to a completely rectangular or square shape, but includes a rectangular or square shape having round corners.

The rectangular center portion of the annular portion of the bobbin is preferably in the form of a perpendicularly extending thin flat plate such that it provides a space for receiving the entire rectangular body of the second core member, the X-axis coil and the Y-axis coil being wound around the rectangular body of the first core member and the annular portion of the bobbin, and the Z-axis coil being wound around the annular portion of the bobbin between the rectangular projections of the bobbin and the rectangular flanges of the second core member.

It is preferable that the rectangular body of the second core member is partially provided with a flat projection, and that the rectangular center portion of the annular portion of the bobbin is in the form of a horizontally extending thin flat plate such that it provides a space for receiving the flat projection of the rectangular body of the second core member, the X-axis coil and the Y-axis coil being wound around the rectangular body of the first core member and the rectangular body of the second core member, and the Z-axis coil being wound around the rectangular body of the second core member between the rectangular projections of the bobbin and the rectangular flanges of the second core member.

The rectangular body of the second core member is preferably provided at corners with fan-shaped projections overlapping part of the rectangular flanges, the Z-axis coil being wound around the fan-shaped projections of the second core member.

The rectangular flanges of the second core member and the rectangular projections of the bobbin preferably constitute a rectangular contour.

The three-axis antenna of the present invention comprises the above core assembly, and an X-axis coil, a Y-axis coil and a Z-axis coil wound around the core assembly, each coil end being connected to each of the terminal members.

BRIEF DESCRIPTION OF THE DRAWINGS

FIG. 2(*b*) is a plan view showing a core assembly used in the three-axis antenna of FIG. 1.

FIG. 3(*b*) is a plan view showing first and second core members combined to constitute the core assembly of FIG. 2.

FIG. 5(*b*) is a plan view showing a second core member constituting the core assembly of FIG. 2.

FIG. 5(*c*) is a bottom view showing a second core member constituting the core assembly of FIG. 2.

FIG. 6(*b*) is a plan view showing a bobbin constituting the core assembly of FIG. 2.

FIG. 6(*c*) is a bottom view showing a bobbin constituting the core assembly of FIG. 2.

FIG. 7(*b*) is a cross-sectional view taken along the line A-A in FIG. 2(*b*).

FIG. 7(*c*) is a cross-sectional view showing a wound coil in the A-A cross-sectional view of FIG. 2(*b*).

FIG. 8(*b*) is a cross-sectional view taken along the line B-B in FIG. 2(*b*).

FIG. 8(*c*) is a cross-sectional view showing a wound coil in the B-B cross-sectional view of FIG. 2(*b*).

FIG. 9(*b*) is a plan view showing a core assembly according to the second embodiment of the present invention.

FIG. 10(*b*) is a plan view showing first and second core members combined to constitute the core assembly of FIG. 9(*a*).

FIG. 12(*b*) is a plan view showing a second core member constituting the core assembly of FIG. 9(*a*).

FIG. 12(*c*) is a bottom view showing a second core member constituting the core assembly of FIG. 9(*a*).

FIG. 13(*b*) is a plan view showing a bobbin constituting the core assembly of FIG. 9(*a*).

FIG. 13(*c*) is a bottom view showing a bobbin constituting the core assembly of FIG. 9(*a*).

FIG. 14(*b*) is a cross-sectional view taken along the line C-C in FIG. 9(*b*).

FIG. 14(*c*) is a cross-sectional view showing a wound coil in the C-C cross-sectional view of FIG. 9(*b*).

FIG. 15(*b*) is a cross-sectional view taken along the line D-D in FIG. 9(*b*).

FIG. 15(*c*) is a cross-sectional view showing a wound coil in the D-D cross-sectional view of FIG. 9(*b*).

FIG. 16(*b*) is a plan view showing a bobbin according to the third embodiment of the present invention.

FIG. 16(*c*) is a bottom view showing a bobbin according to the third embodiment of the present invention.

FIG. 18(*b*) is a perspective view showing a three-axis antenna device with terminal members bent.

FIG. 22(*b*) is a plan view showing the size of the second core member in Example 1.

FIG. 23(*b*) is a plan view showing the size of the bobbin in Example 1.

FIG. 24(*b*) is a side view showing the core of FIG. 24(*a*).

FIG. 24(*c*) is a front view showing a three-axis antenna disclosed in JP 2004-015168 A.

FIG. 24(*d*) is a side view showing the three-axis antenna of FIG. 24(*c*).

FIG. 24(*e*) is a front view showing a core piece used in another three-axis antenna disclosed in JP 2004-015168 A.

FIG. 24(*f*) is a front view showing a core assembly used in another three-axis antenna disclosed in JP 2004-015168 A.

DESCRIPTION OF THE PREFERRED EMBODIMENTS

The embodiments of the present invention will be explained in detail below referring to the attached drawings without intention of restricting the present invention thereto, and proper modifications may be made if necessary.

[1] First Embodiment

Figure 1:
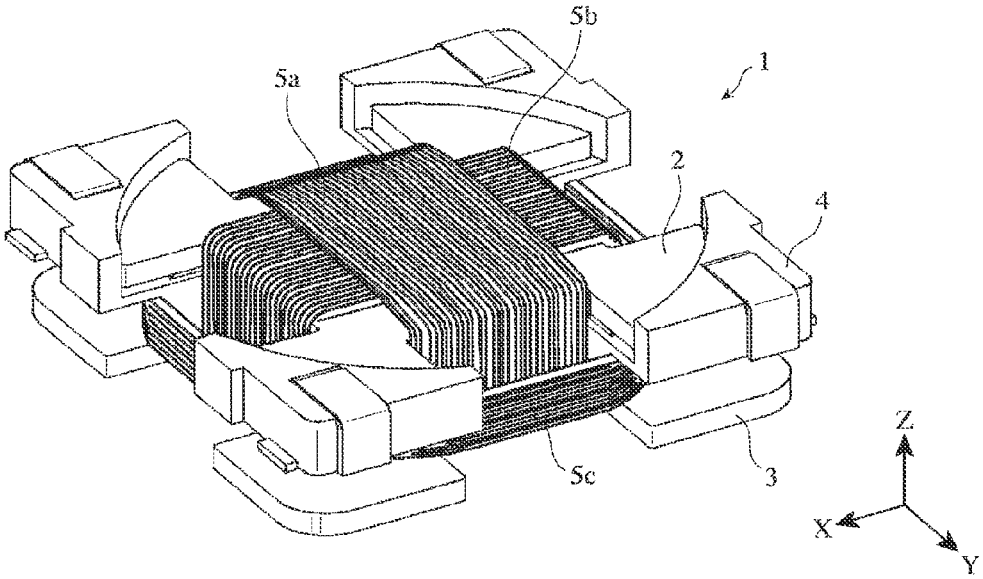
FIG. 1 is a perspective view showing a three-axis antenna according to the first embodiment of the present invention.
Figure 2A:
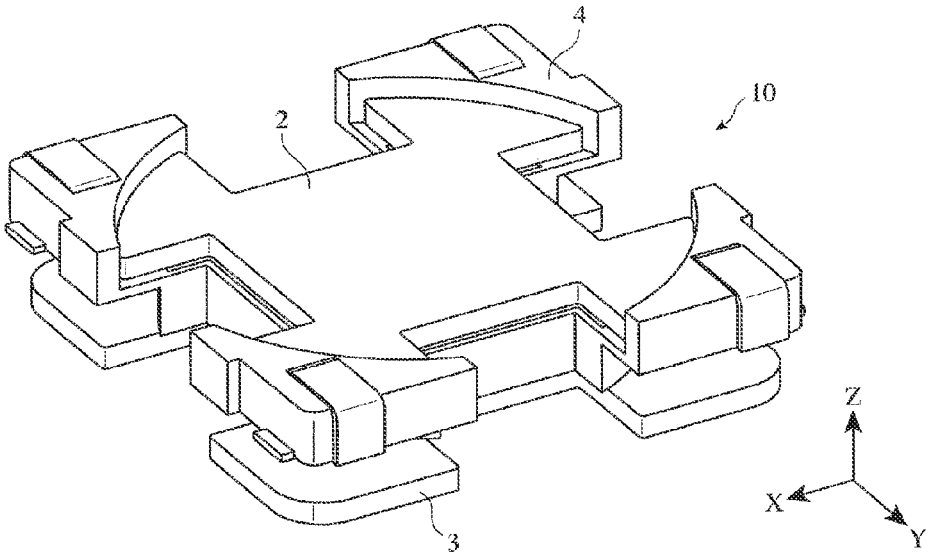
FIG. 2(*a*) is a perspective view showing a core assembly used in the three-axis antenna of FIG. 1.
Figure 2B:
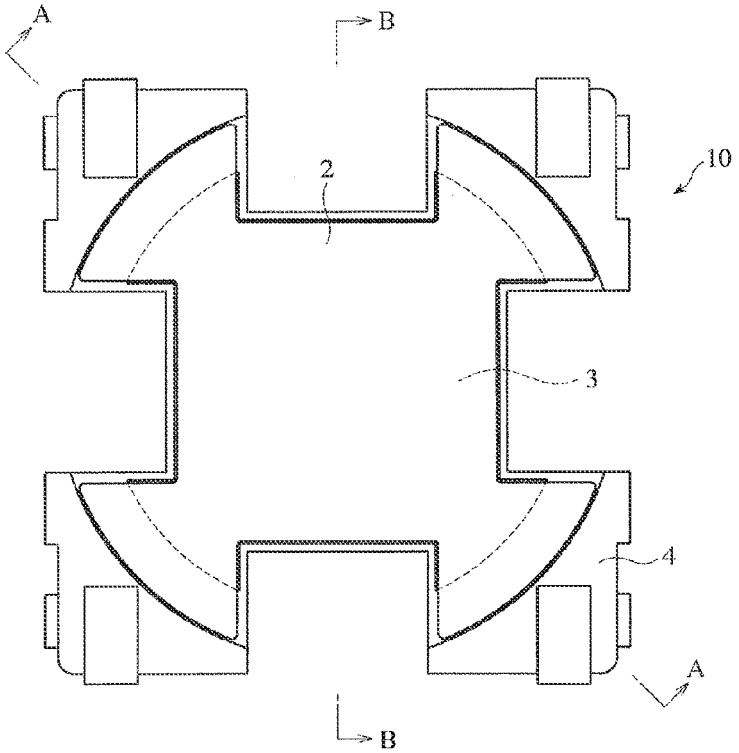

FIG. 1 shows a three-axis antenna according to the first embodiment of the present invention, and FIGS. 2(*a*) and 2(*b*) show a core assembly 10 constituting the three-axis antenna. The three-axis antenna 1 comprises a core assembly 10 comprising first and second core members 2, 3 and a bobbin 4, and an X-axis coil 5*a*, a Y-axis coil 5*b* and a Z-axis coil 5*c* wound around the core assembly 10 for receiving electromagnetic waves three-dimensionally. In the core assembly 10, the bobbin 4 is disposed between the first core member 2 and the second core member 3 to fix the first and second core members 2, 3 with space for winding the Z-axis coil 5*c*.

Figure 3A:
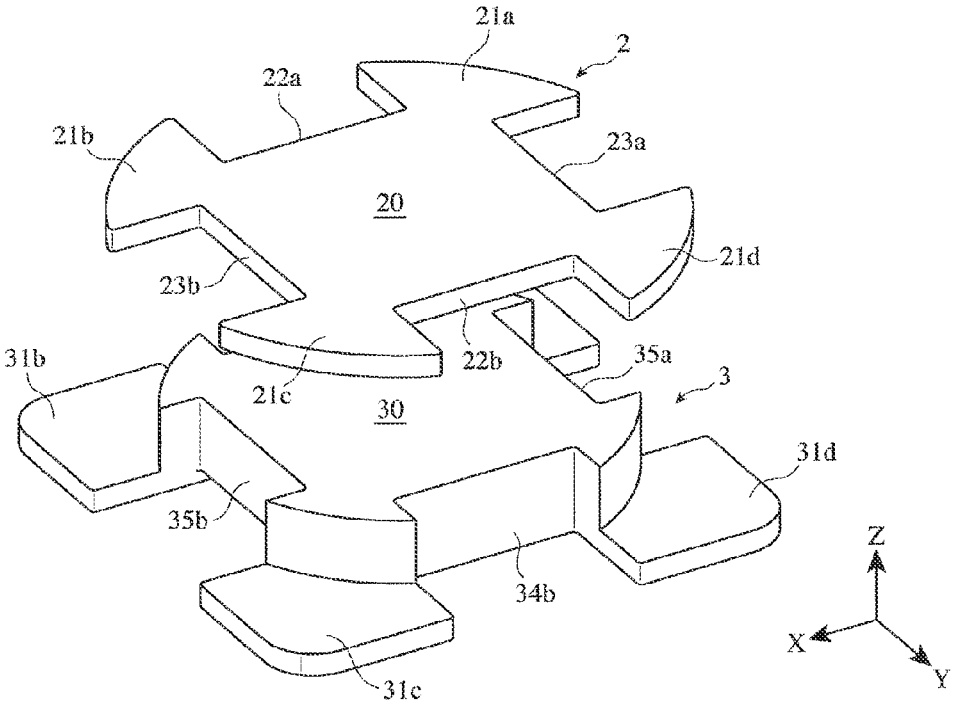
FIG. 3(*a*) is a perspective view showing first and second core members constituting the core assembly of FIG. 2.
Figure 3B:
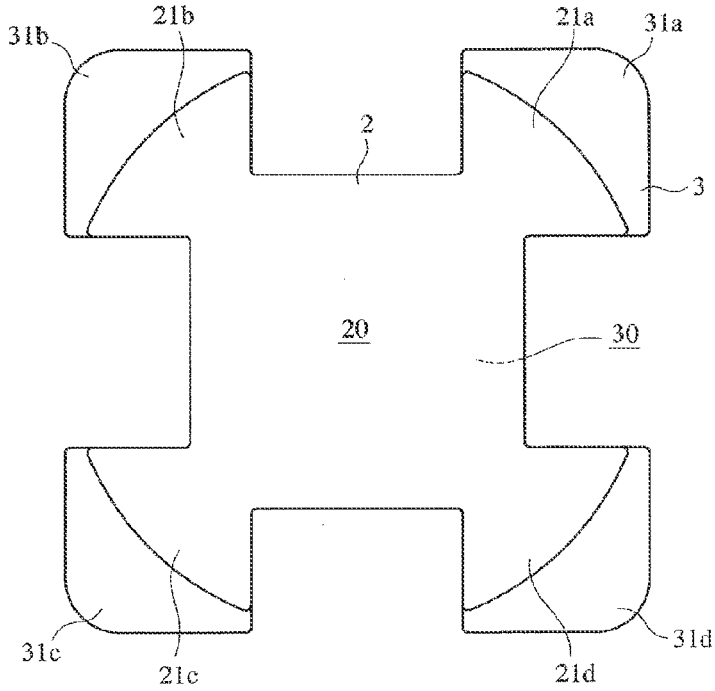
Figure 4:
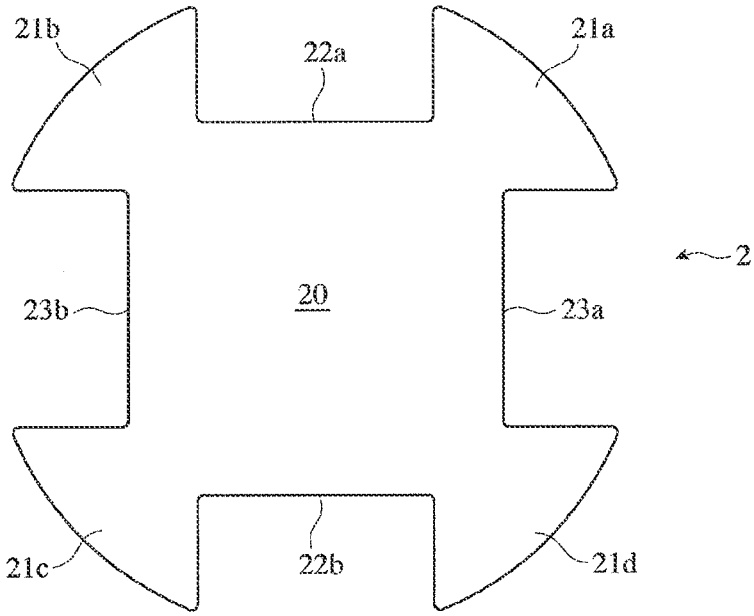
FIG. 4 is a plan view showing a first core member constituting the core assembly of FIG. 2.

As shown in FIGS. 3(*a*), 3(*b*) and 4, the first core member 2 is in the form of a thin, integral, flat plate having a flat bottom surface, comprising a substantially square body 20, and fan-shaped flanges 21*a*, 21*b*, 21*c*, 21*d* integrally projecting from four corners of the body 20 diagonally (in four perpendicular directions) in an X-Y plane. The body 20 has side surfaces 22*a*, 22*b* around which the X-axis coil 5*a* is wound, and side surfaces 23*a*, 23*b* around which the Y-axis coil 5*b* is wound. In this embodiment, the body 20 and the fan-shaped flanges 21*a*, 21*b*, 21*c*, 21*d* have the same thickness.

Figure 5A:
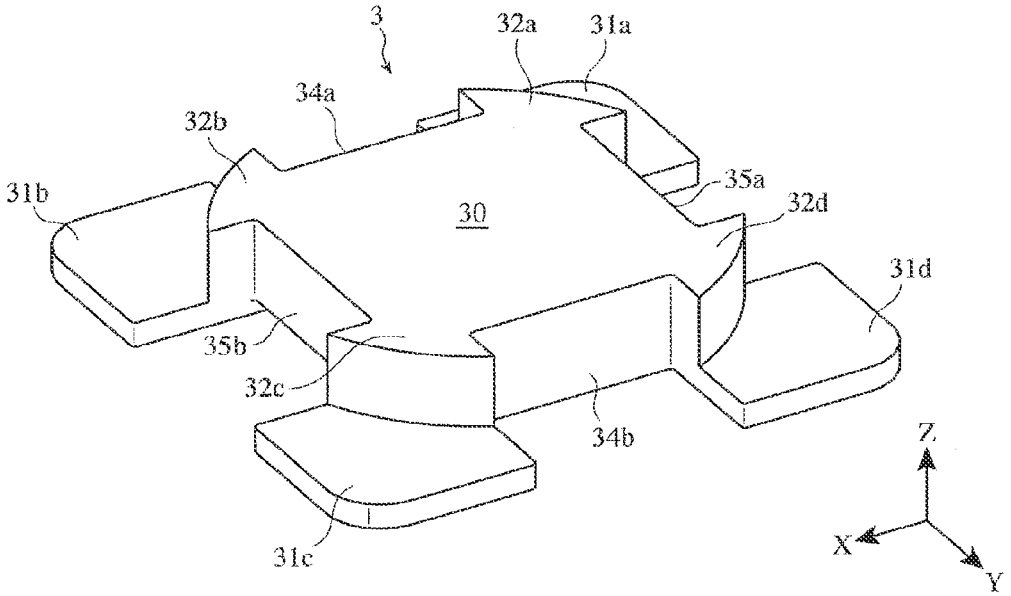
FIG. 5(*a*) is a perspective view showing a second core member constituting the core assembly of FIG. 2.
Figure 5B:
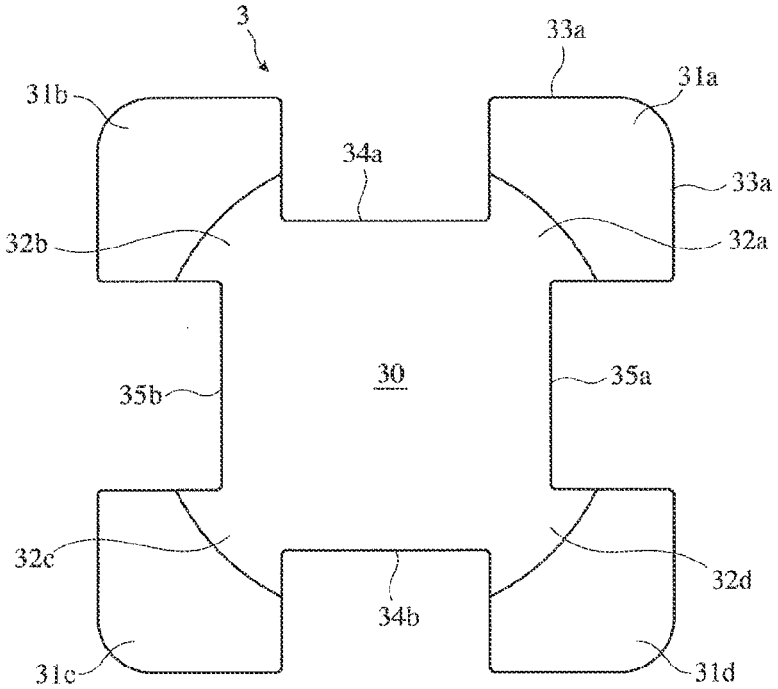
Figure 5C:
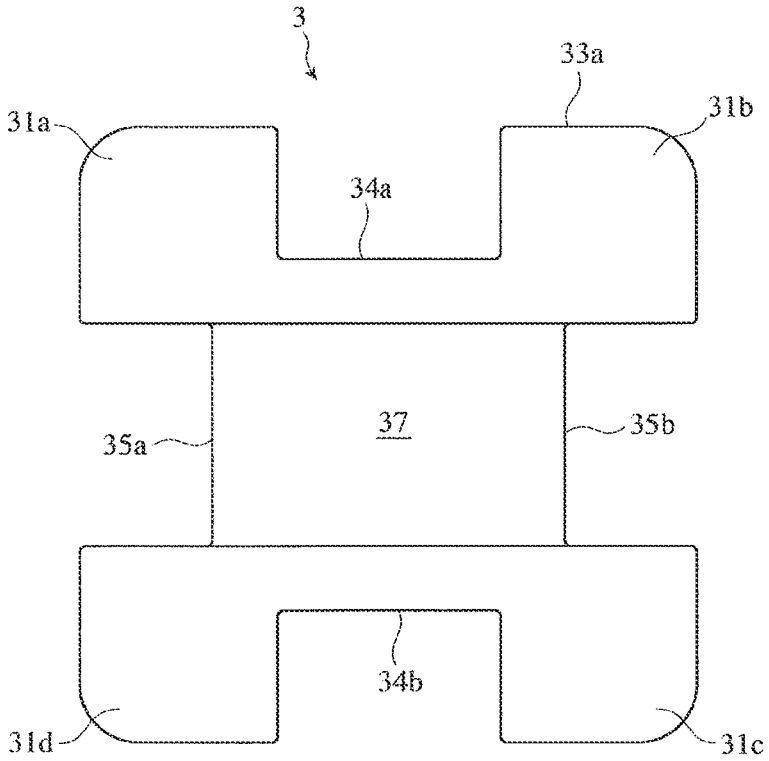

As shown in FIGS. 3(*a*), 3(*b*), 5(*a*) and 5(*b*), the second core member 3 overlapping the first core member 2 in a Z direction comprises a body 30 thicker than the first core member 2, fan-shaped projections 32*a*, 32*b*, 32*c*, 32*d* having the same thickness as that of the body 30 and integrally projecting from four corners of the body 30 diagonally (in four perpendicular directions) in an X-Y plane, and substantially rectangular flanges 31*a*, 31*b*, 31*c*, 31*d* integrally projecting from a lower end of each fan-shaped projection 32*a*, 32*b*, 32*c*, 32*d* diagonally (in four perpendicular directions) in an X-Y plane. The body 30 has side surfaces 34*a*, 34*b* around which the X-axis coil 5*a* is wound, and side surfaces 35*a*, 35*b* around which the Y-axis coil 5*b* is wound. In this embodiment, the body 30, fan-shaped projections 32*a*, 32*b*, 32*c*, 32*d* and rectangular flanges 31*a*, 31*b*, 31*c*, 31*d* of the second core member 3 have bottom surfaces on the same plane, and upper flat surfaces. Accordingly, the first and second core members 2, 3 are in contact with each other with flat surfaces. As shown in FIG. 5(*c*), the second core member 3 is provided on the bottom surface with a shallow groove 37 connecting the side surfaces 35*a*, 35*b*. The groove 37 receives the Y-axis coil 5*b*.

Because two outer sides (for example, two sides 33*a*, 33*a* of the rectangular flange 31*a*) of each rectangular flange 31*a*, 31*b*, 31*c*, 31*d* of the second core member 3 are perpendicular to each other, the second core member 3 has a substantially rectangular (for example, square) contour as a whole. Also, because a circular contour defined by the fan-shaped flanges 21*a*, 21*b*, 21*c*, 21*d* of the first core member 2 has a smaller diameter than the length of a rectangular (for example, square) contour defined by the rectangular flanges 31*a*, 31*b*, 31*c*, 31*d* of the second core member 3 as shown in FIG. 3(*b*), the first core member 2 is positioned inside the second core member 3 when the first core member 2 overlaps the second core member 3 in a Z direction.

Figure 6A:
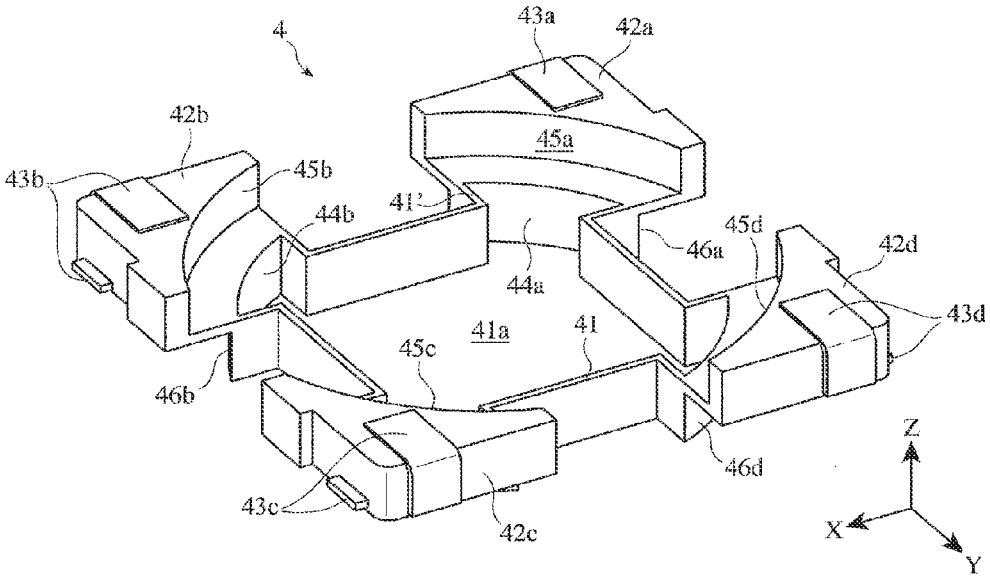
FIG. 6(*a*) is a perspective view showing a bobbin constituting the core assembly of FIG. 2.
Figure 6B:
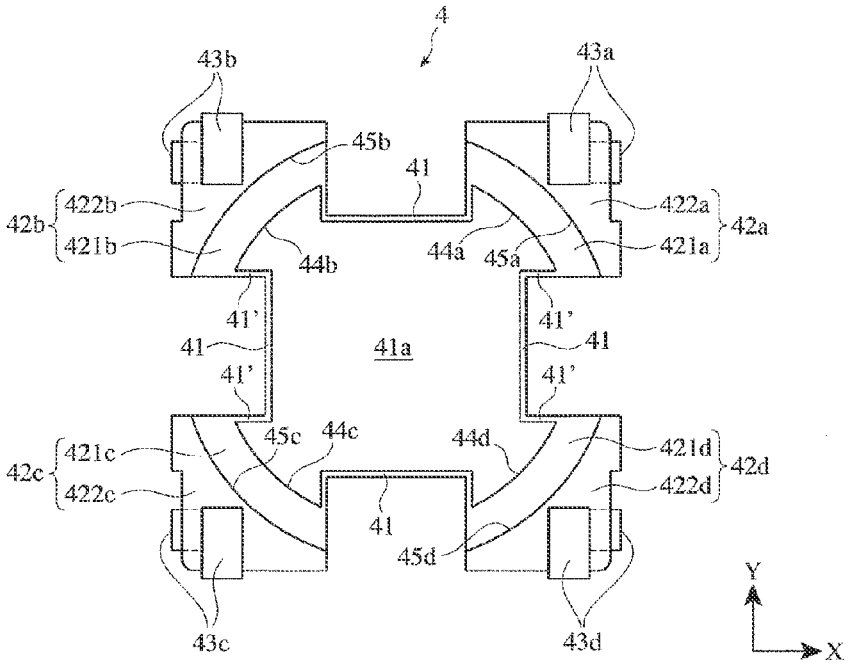
Figure 6C:
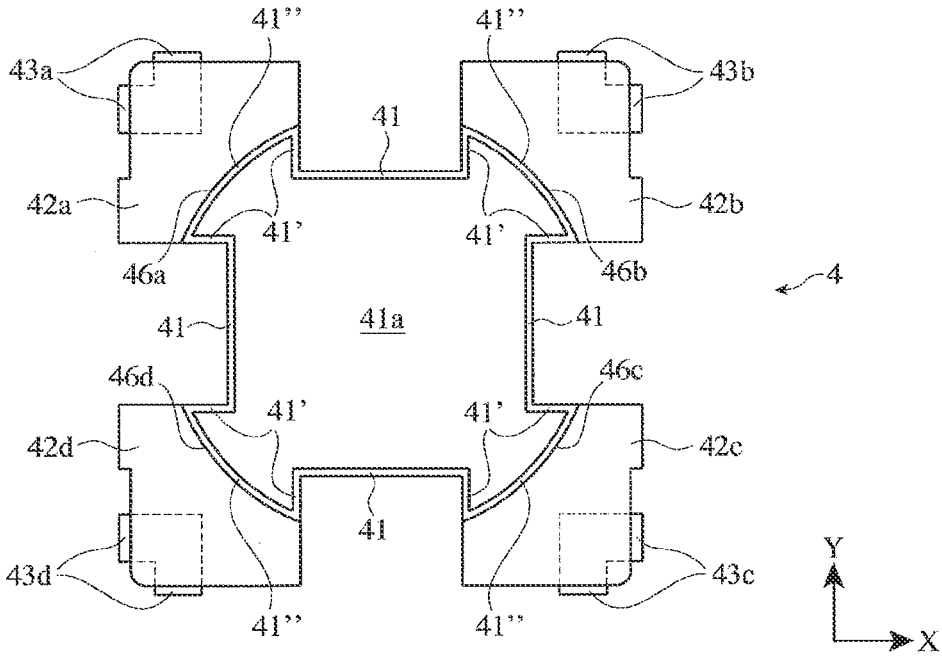

As shown in FIGS. 6(*a*)-6(*c*), the bobbin 4 comprises vertical, rectangular (for example, square), annular portions 41, and rectangular projections 42*a*, 42*b*, 42*c*, 42*d* integrally provided at four corners of the vertical, rectangular, annular portions 41. Each rectangular projection 42*a*, 42*b*, 42*c*, 42*d* integrally comprises linear vertical walls 41' each extending straight with the same height from each end of the vertical, rectangular, annular portions 41 such that they expand in perpendicular directions; vertical walls 41" connected to both linear vertical walls 41' with the same height, which is in a circular shape having a center at the Z-axis; thin, fan-shaped, flat portions 421*a*, 421*b*, 421*c*, 421*d* each horizontally extending from an upper surface of each circular vertical wall 41"; and projection bodies 422*a*, 422*b*, 422*c*, 422*d* each higher (thicker) than each fan-shaped, flat portion 421*a*, 421*b*, 421*c*, 421*d*. The upper surfaces of the linear vertical walls 41' and the fan-shaped, flat portions 421*a*, 421*b*, 421*c*, 421*d* have the same height as that of the upper surfaces of the vertical, rectangular, annular portions 41. Each circular vertical wall 41" has an annular inner surface 44*a*, 44*b*, 44*c*, 44*d* and an annular outer surface 46*a*, 46*b*, 46*c*, 46*d*, which are vertical (oriented in the Z direction) and circular with a center at the Z-axis. Accordingly, a space 41*a* comprises a rectangular (for example, square) space defined by four vertical, rectangular, annular portions 41, and fan-shaped spaces each defined by a pair of linear vertical walls 41' and each circular annular inner surface 44*a*, 44*b*, 44*c*, 44*d*. An inner side of each projection body 422*a*, 422*b*, 422*c*, 422*d* is connected to each annular inner surface 45*a*, 45*b*, 45*c*, 45*c*, which is vertical (oriented in the Z direction) and circular with a center at the Z-axis.

A terminal member 43*a*, 43*b*, 43*c*, 43*d* is fixed to each projection body 422*a*, 422*b*, 422*c*, 422*d*, and electrically connected to a circuit board. Each terminal member turns 90° in each projection body 422*a*, 422*b*, 422*c*, 422*d*, and fixed to a resin by insert molding such that both ends thereof are exposed on side surfaces. Because the ends of the X-axis coil 5*a*, the Y-axis coil 5*b* and the Z-axis coil 5*c* can be connected to the terminal members 43*a*, 43*b*, 43*c*, 43*d* from both sides of the bobbin 4, the connection operation of coils can be completed by one step without rotating the bobbin 4 by 90°, resulting in excellent mass productivity. In the depicted example, one end portion of each terminal member 43*a*, 43*b*, 43*c*, 43*d* is bent, extends on an upper surface of each projection body 422*a*, 422*b*, 422*c*, 422*d*, and is connected to an electrode of the circuit board. The other end portion of each terminal member 43*a*, 43*b*, 43*c*, 43*d* is exposed on a side surface, and connected to an end of each coil.

To make the three-axis antenna 1 low in height, the terminal members 43*a*, 43*b*, 43*c*, 43*d* are preferably exposed on the side surfaces of the bobbin 4. Because too large terminal members 43*a*, 43*b*, 43*c*, 43*d* act as magnetic shields, reducing magnetic flux passing through the X-axis coil 5*a*, the Y-axis coil 5*b* and the Z-axis coil 5*c*, they are preferably as small as possible. The terminal members 43*a*, 43*b*, 43*c*, 43*d* are preferably disposed at positions not overlapping the X-axis coil 5*a*, the Y-axis coil 5*b* and the Z-axis coil 5*c*.

Figure 7A:
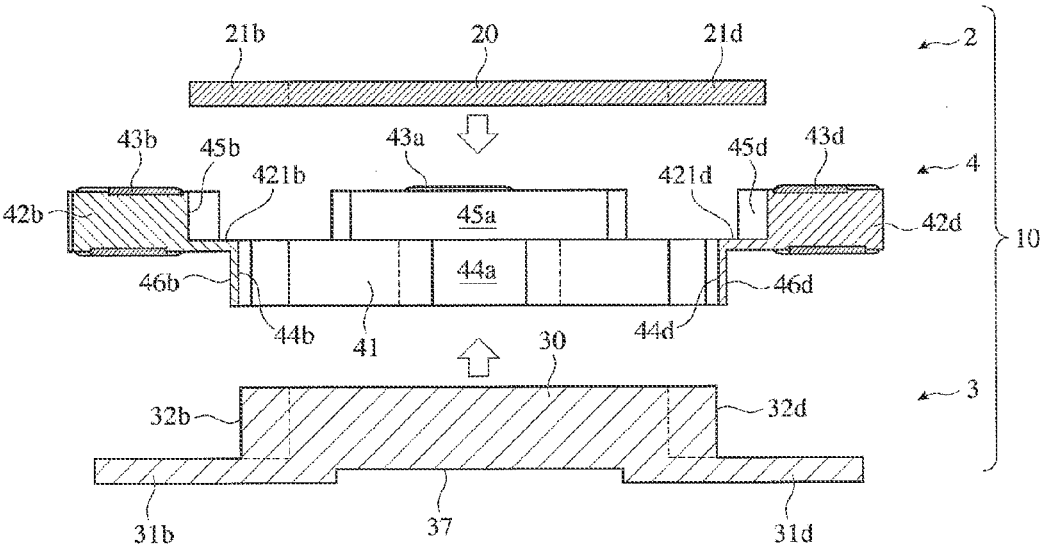
FIG. 7(*a*) is an exploded cross-sectional view taken along the line A-A in FIG. 2(*b*).
Figure 7B:
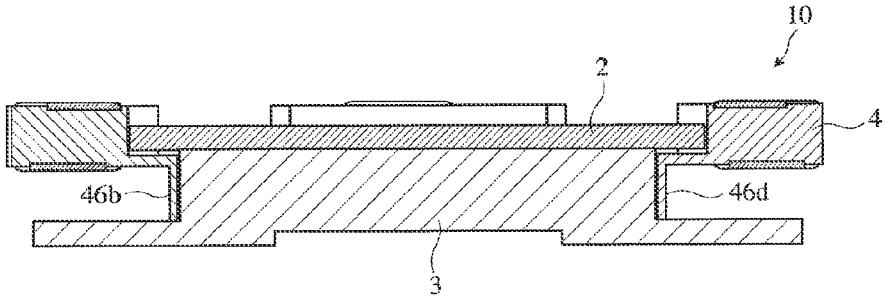
Figure 7C:
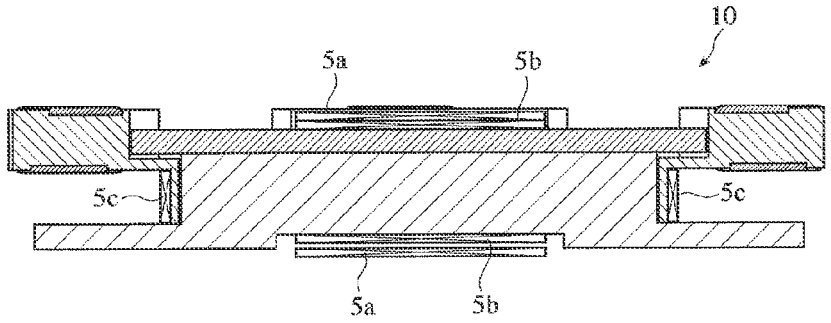
Figure 8A:
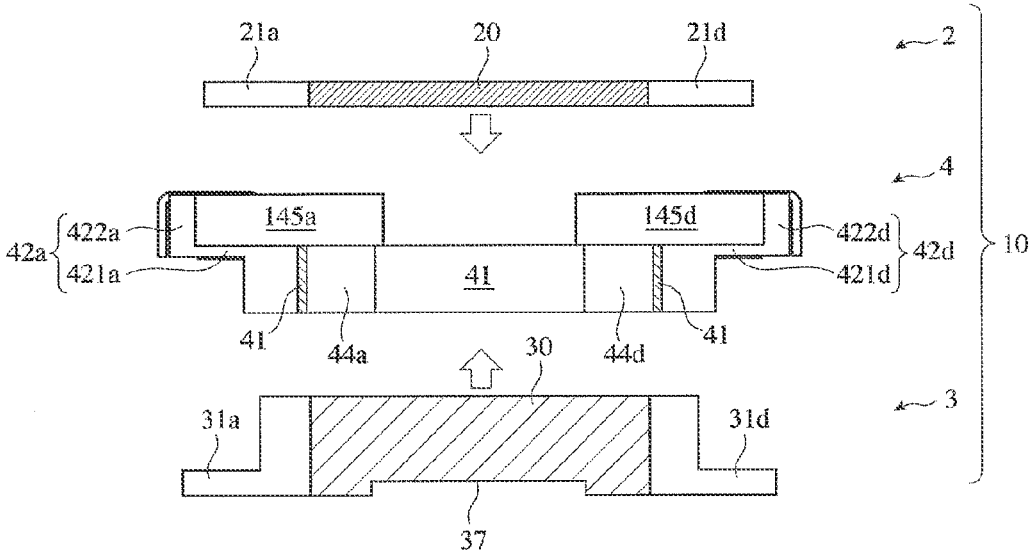
FIG. 8(*a*) is an exploded cross-sectional view taken along the line B-B in FIG. 2(*b*).
Figure 8B:
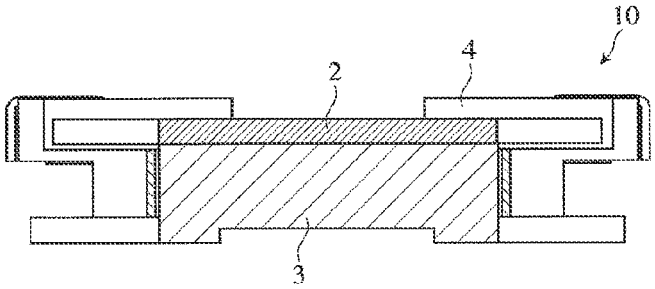
Figure 8C:
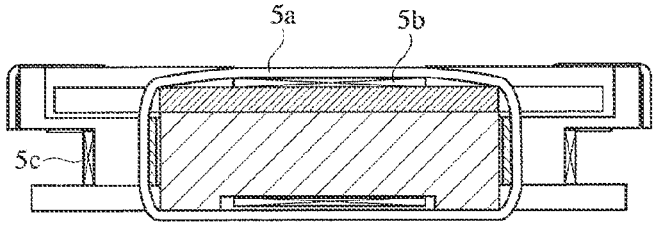

As shown in FIGS. 7(*a*), 7(*b*), 8(*a*) and 8(*b*), because a diameter of a circular contour defined by the fan-shaped flanges 21*a*, 21*b*, 21*c*, 21*d* of the first core member 2 is slightly smaller than a diameter of the circular inner surfaces 45*a*, 45*b*, 45*c*, 45*d* of the projection bodies 422*a*, 422*b*, 422*c*, 422*d* of the bobbin 4, the first core member 2 is received in a space defined by the vertical, rectangular, annular portions 41 and the fan-shaped, flat portions 421*a*, 421*b*, 421*c*, 421*d* in the bobbin 4, with a small gap between the fan-shaped flanges 21*a*, 21*b*, 21*c*, 21*d* and the circular inner surfaces 45*a*, 45*b*, 45*c*, 45*d*.

As shown in FIGS. 7(*a*), 7(*b*), 8(*a*) and 8(*b*), because the rectangular body 30 of the second core member 3 is slightly smaller than the inner surfaces of the vertical, rectangular, annular portions 41 of the bobbin 4, and because a contour defined by the fan-shaped projections 32*a*, 32*b*, 32*c*, 32*d* of the second core member 3 is slightly smaller than a contour defined by the linear vertical walls 41' and the annular inner surfaces 44*a*, 44*b*, 44*c*, 44*d* of the bobbin 4, the rectangular body 30 and fan-shaped projections 32*a*, 32*b*, 32*c*, 32*d* of the second core member 3 are received in the space 41*a* of the bobbin 4 with a small gap.

The height of the vertical, rectangular, annular portions 41, vertical linear walls 41' and annular inner surfaces 44*a*, 44*b*, 44*c*, 44*d* of the bobbin 4 is substantially the same as the difference between the upper surfaces of the body 30 and fan-shaped projections 32*a*, 32*b*, 32*c*, 32*d* of the second core member 3 and the upper surfaces of the rectangular flanges 31*a*, 31*b*, 31*c*, 31*d*. Accordingly, when the body 30 and fan-shaped projections 32*a*, 32*b*, 32*c*, 32*d* of the second core member 3 are received in the vertical, rectangular, annular portions 41, vertical linear walls 41' and annular inner surfaces 44*a*, 44*b*, 44*c*, 44*d* of the bobbin 4, the upper surfaces of the body 30 and the fan-shaped projections 32*a*, 32*b*, 32*c*, 32*d*, and the upper surfaces of the vertical, rectangular, annular portions 41, vertical linear walls 41' and fan-shaped, flat portions 421*a*, 421*b*, 421*c*, 421*d* of the bobbin 4 are positioned substantially on the same plane.

Further, because a bottom surface of the body 20 of the first core member 2 and an upper surface of the body 30 of the second core member 3 having substantially the same size at substantially the same position, the body 20 substantially overlaps the body 30. With both bodies 20 and 30 overlapping substantially completely, a flat bottom surface of the first core member 2 is substantially in contact with the upper surfaces of the body 30 and the annular inner surfaces 44*a*, 44*b*, 44*c*, 44*d* of the second core member 3 and the upper surfaces of the fan-shaped, flat portions 421*a*, 421*b*, 421*c*, 421*d* of the bobbin 4, permitting magnetic flux to flow efficiently. The first and second core members 2, 3 preferably have direct contact, though there may be such a magnetic gap as not to substantially hinder the flow of magnetic flux. The magnetic gap may be a resin adhesive layer or part of the bobbin 4. When the magnetic gap is a resin adhesive layer, it is not different from electrical direct contact as long as it is as thin as 100 μm or less. The magnetic gap is preferably 50 μm or less.

Because a rectangular contour defined by the rectangular flanges 31*a*, 31*b*, 31*c*, 31*d* of the second core member 3 is substantially the same as a rectangular contour defined by the rectangular projections 42*a*, 42*b*, 42*c*, 42*d* of the bobbin 4, the second core member 3 overlaps the bobbin 4 substantially completely in a Z direction. The first core member 2 received in the bobbin 4 with a small gap between it and the circular inner surfaces 45*a*, 45*b*, 45*c*, 45*d* is positioned inside the second core member 3 on an X-Y plane. Accordingly, the combination of the first and second core members 2, 3 on both surfaces of the bobbin 4 provides a substantially rectangular core assembly 10. The terminal members 43*a*, 43*b*, 43*c*, 43*d* provided on the rectangular projections 42*a*, 42*b*, 42*c*, 42*d* of the bobbin 4 are positioned in a rectangular contour of the core assembly 10.

As shown in FIGS. 2(*a*), 2(*b*) and 3(*a*), the core assembly 10 is provided with recesses extending in X and Y directions on its sides; a coil 5*a* having an axis in an X direction (simply called "X-axis coil") is wound around a pair of recesses facing the side surfaces 22*a*, 22*b* of the first core member 2 and the side surfaces 34*a*, 34*b* of the second core member 3, and a coil 5*b* having an axis in a Y direction (simply called "Y-axis coil") is wound around a pair of recesses facing the side surfaces 23*a*, 23*b* of the first core member 2 and the side surfaces 35*a*, 35*b* of the second core member 3. A coil 5*c* having an axis in a Z direction (simply called "Z-axis coil") is wound around the circular, annular, outer surfaces 46*a*, 46*b*, 46*c*, 46*d* of the circular vertical walls 41" of the bobbin 4. The circular, annular, outer surfaces 46*a*, 46*b*, 46*c*, 46*d* are positioned outside the vertical, rectangular, annular portions 41 around which the X-axis coil 5*a* and the Y-axis coil 5*b* are wound. Accordingly, after the X-axis coil 5*a* and the Y-axis coil 5*b* are wound around the vertical, rectangular, annular portions 41 and the side surfaces 22*a*, 22*b*, 23*a*, 23*b* of the first core member 2, the Z-axis coil 5*c* can be easily wound around the circular, annular, outer surfaces 46*a*, 46*b*, 46*c*, 46*d* without contact with the X-axis coil 5*a* and the Y-axis coil 5*b*.

To assemble the three-axis antenna in the first embodiment, as shown in FIGS. 7(*a*), 7(*b*), 8(*a*) and 8(*b*), the body 30 and fan-shaped projections 32*a*, 32*b*, 32*c*, 32*d* of the second core member 3 are inserted from below into a space 41*a* defined by the vertical, rectangular, annular portions 41, vertical linear walls 41' and circular vertical walls 41" of the bobbin 4, and the first core member 2 is inserted from above into a space defined by the vertical, rectangular, annular portions 41, vertical linear walls 41' and fan-shaped, flat portions 421*a*, 421*b*, 421*c*, 421*d* of the bobbin 4. The body 20 of the first core member 2 and the body 30 of the second core member 3 in contact with each other in the vertical, rectangular, annular portions 41 may be bonded. Of course, the first core member 2 may be bonded to the fan-shaped, flat portions 421*a*, 421*b*, 421*c*, 421*d* of the bobbin 4. Thus, the core assembly 10 is obtained.

With one end connected to one terminal member (for example, 43*a*) by solder, etc., a copper wire is wound around the X-direction, vertical, rectangular, annular portions 41 of the bobbin 4, which face the side surfaces 22*a*, 22*b*, 34*a*, 34*b* of the first and second core members 2, 3, to form the X-axis coil 5*a*, and the other end of the copper wire is connected to another terminal member 43*c*. Next, with one end connected to the terminal member 43*b*, a copper wire is wound around the Y-direction, vertical, rectangular, annular portions 41 of the bobbin 4, which face the side surfaces 23*a*, 23*b*, 35*a*, 35*b* of the first and second core members 2, 3, to form the Y-axis coil 5*b*, and the other end of the copper wire is connected to another terminal member 43*c*. Finally, with one end connected to the terminal member 43*d*, a copper wire is wound around the circular, annular, outer surfaces 46*a*, 46*b*, 46*c*, 46*d* of the circular vertical walls 41" of the bobbin 4 to form the Z-axis coil 5*c*, and the other end of the copper wire is connected to another terminal member 43*c*. Thus, the terminal member 43*c* acts as a common end of the X-axis coil 5*a*, the Y-axis coil 5*b* and the Z-axis coil 5*c*.

[2] Second Embodiment

Figure 9A:
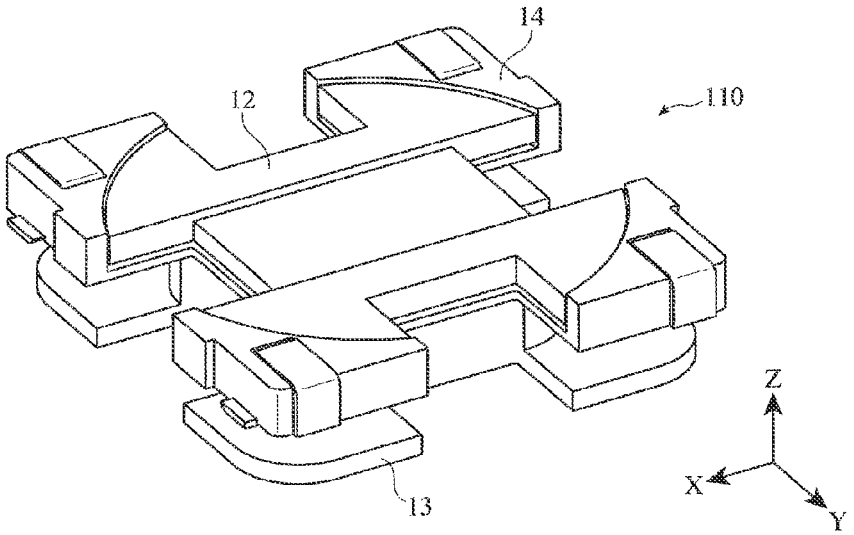
FIG. 9(*a*) is a perspective view showing a core assembly according to the second embodiment of the present invention.
Figure 9B:
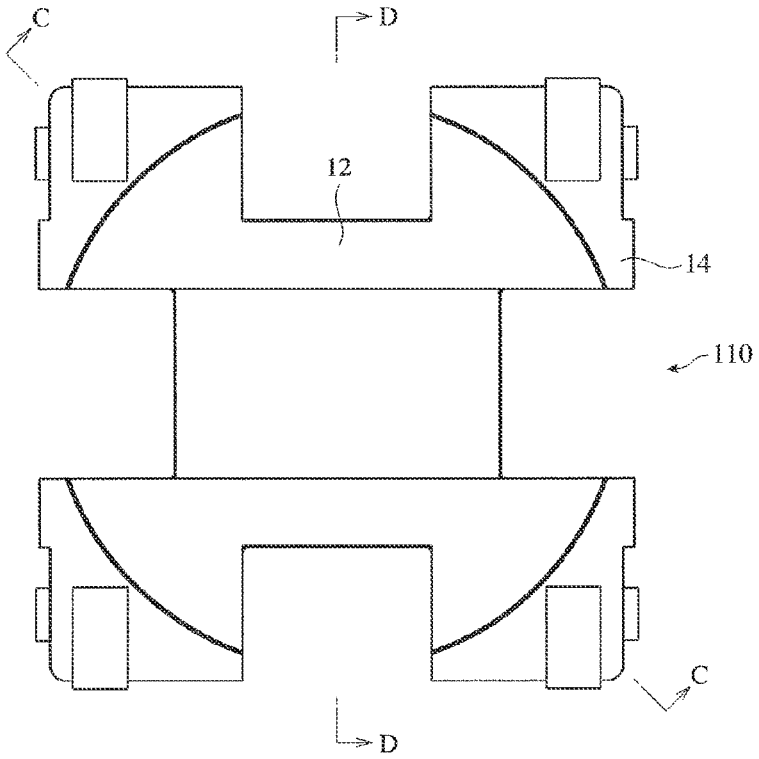
Figure 10A:
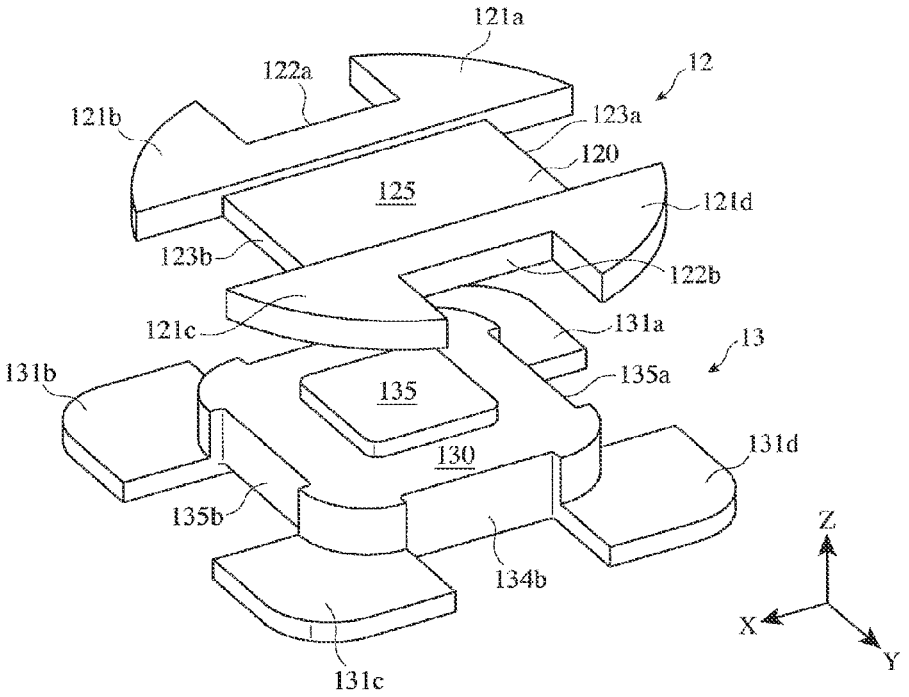
FIG. 10(*a*) is a perspective view showing first and second core members constituting the core assembly of FIG. 9(*a*).
Figure 10B:
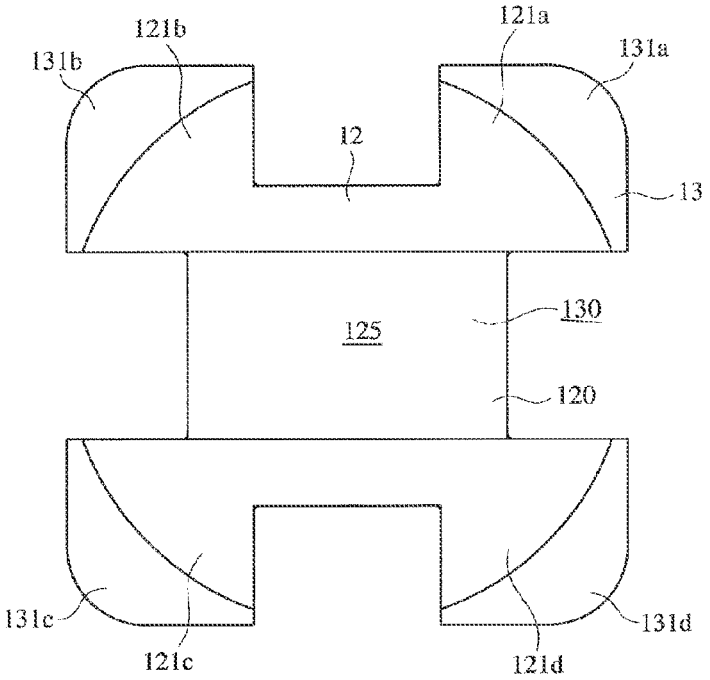
Figure 11:
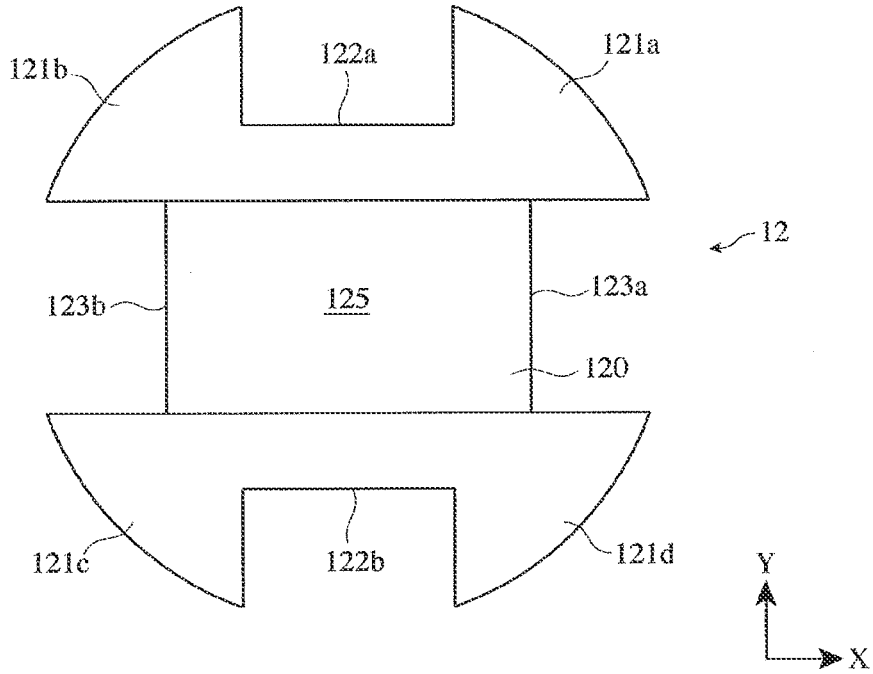
FIG. 11 is a plan view showing a first core member constituting the core assembly of FIG. 9(*a*).
Figure 12A:
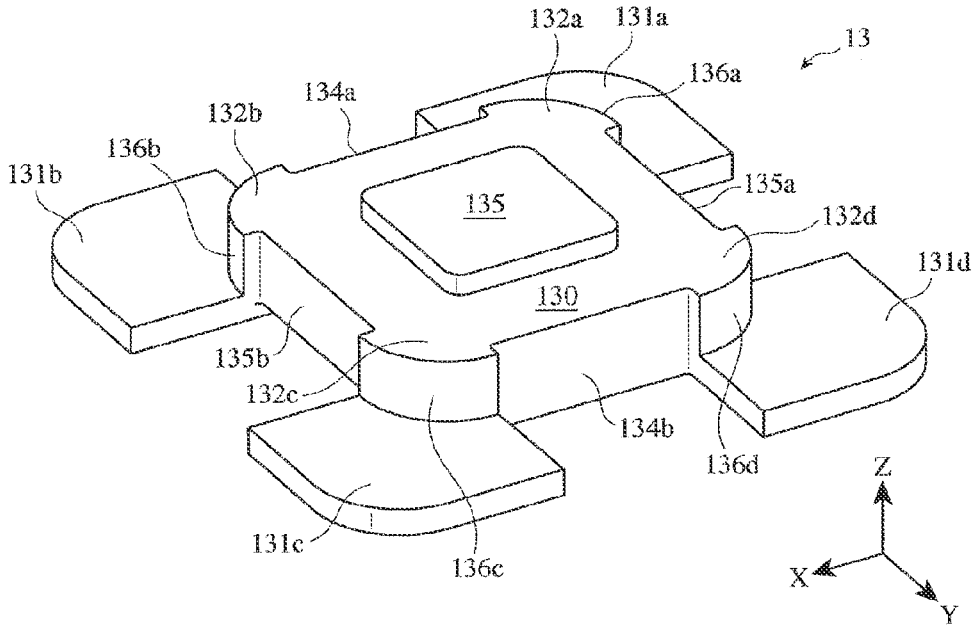
FIG. 12(*a*) is a perspective view showing a second core member constituting the core assembly of FIG. 9(*a*).
Figure 12B:
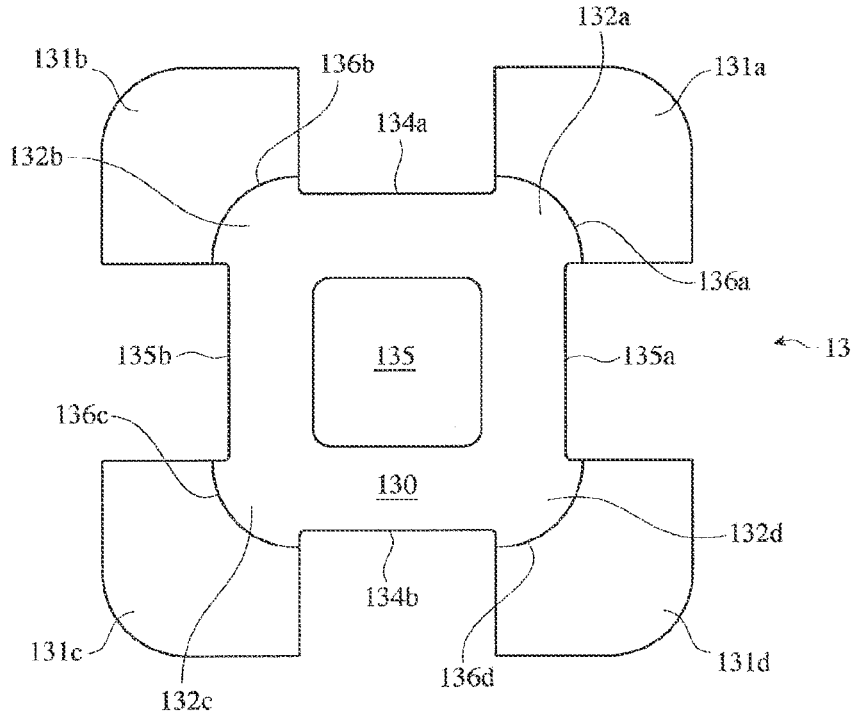
Figure 12C:
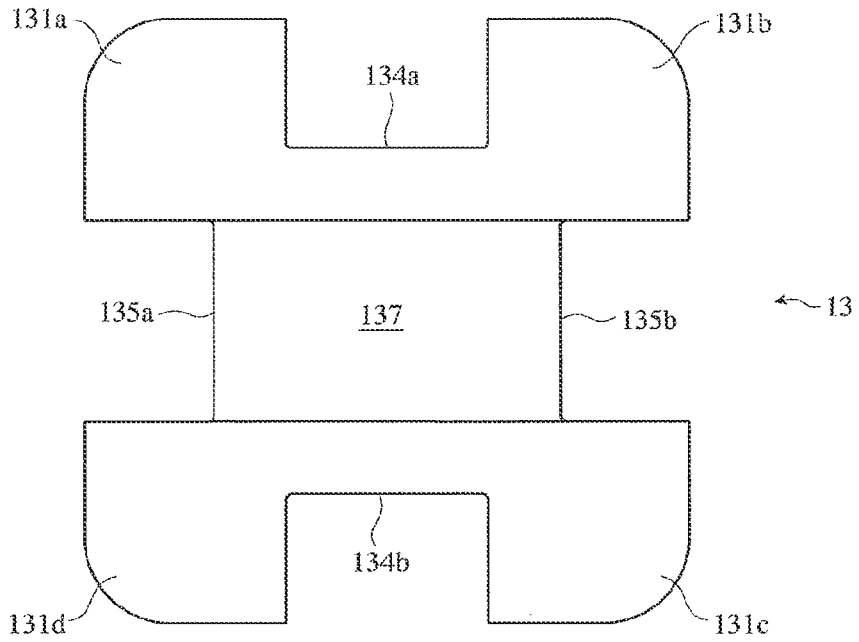
Figure 13A:
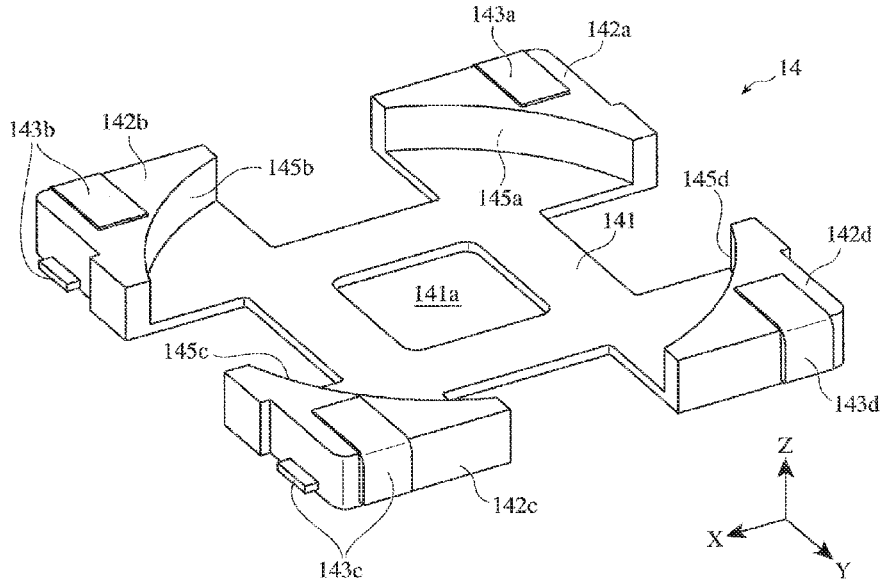
FIG. 13(*a*) is a perspective view showing a bobbin constituting the core assembly of FIG. 9(*a*).
Figure 13B:
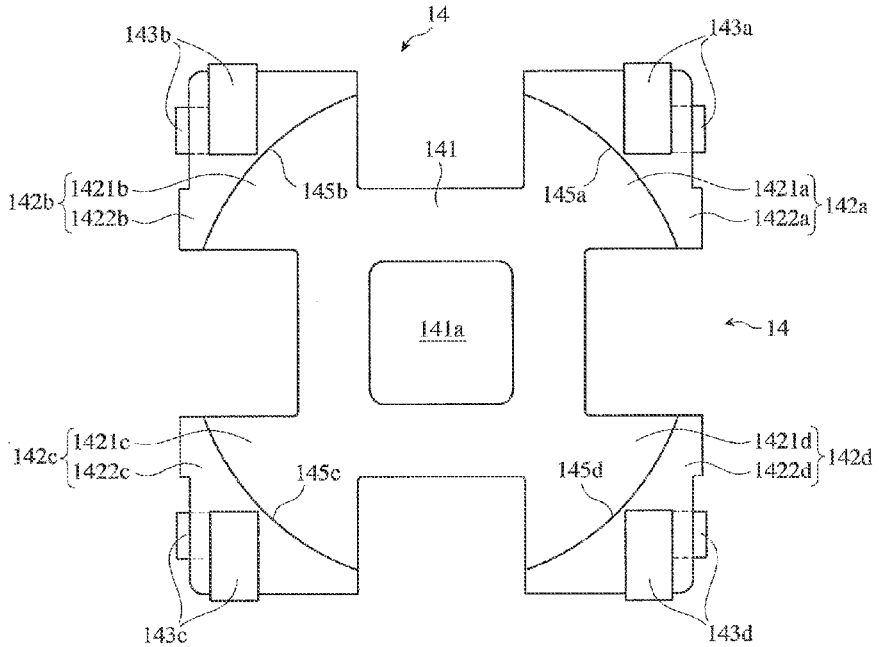
Figure 13C:
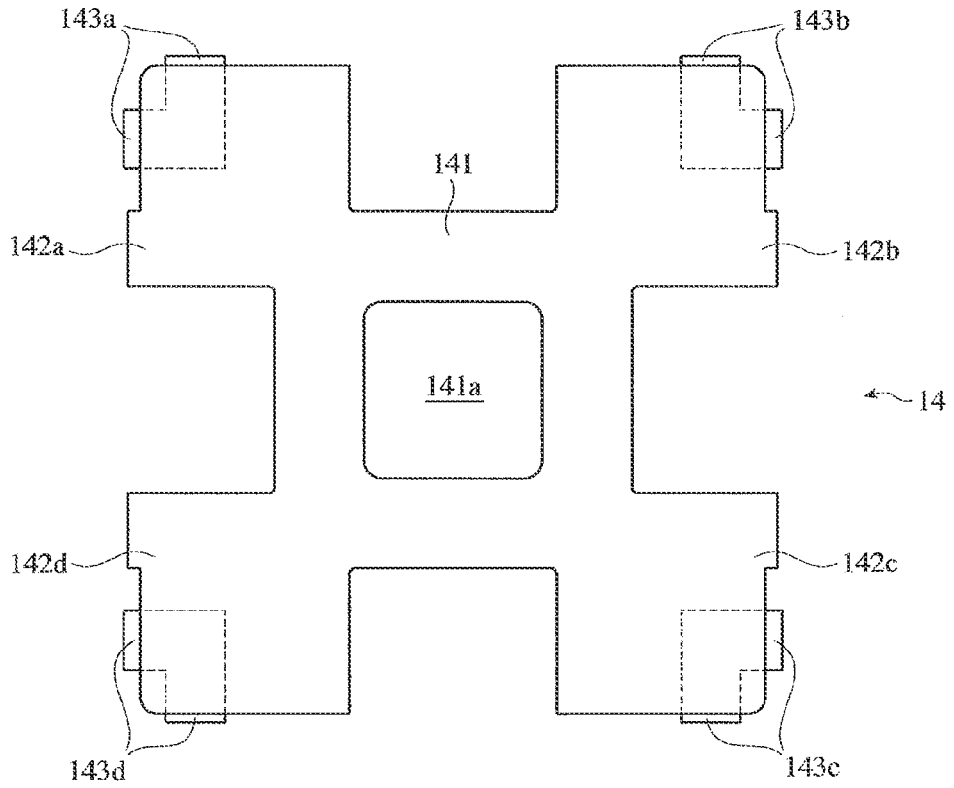

FIGS. 9(*a*) and 9(*b*) show a core assembly 110 according to the second embodiment of the present invention, FIGS. 10(*a*)

and 10(*b*) show a combination of first and second core members 12, 13 constituting the core assembly 110, FIG. 11 shows the first core member 12, FIGS. 12(*a*)-12(*c*) show the second core member 13, and FIGS. 13(*a*)-13(*c*) show a bobbin 14. In FIGS. 9-13, members and portions corresponding to those in the first embodiment are given reference numerals having "1" added to the heads of reference numerals in the first embodiment. For example, a flange 121*a* of the first core member 12 corresponds to the flange 21*a* of the first core member 2 in the first embodiment. With respect to members and portions common to the first embodiment, explanations in the first embodiment are applicable, and thus only structures peculiar to the second embodiment are explained in detail below.

The first core member 12 has substantially the same shape as that of the first core member 2 in the first embodiment, except that an upper surface of a body 120 is provided with a groove 125 extending in an X direction. The second core member 13 has substantially the same shape as that of the second core member 3 in the first embodiment, except that an upper surface of a body 130 is provided with a flat, rectangular (for example, square) projection 135 in a center portion. In the depicted example, fan-shaped projections 132*a*, 132*b*, 132*c*, 132*d* integrally and diagonally extending from corners of the body 130 are smaller than the fan-shaped projections 32*a*, 32*b*, 32*c*, 32*d* in the first embodiment. However, because a Z-axis coil is wound around circular peripheral surfaces 136*a*, 136*b*, 136*c*, 136*d* of the fan-shaped projections 132*a*, 132*b*, 132*c*, 132*d*, the sizes of the fan-shaped projections 132*a*, 132*b*, 132*c*, 132*d* may be properly set depending on the positional relations of the X-axis coil and the Y-axis coil to the Z-axis coil.

A bobbin 14 has substantially the same shape as that of the bobbin 4 in the first embodiment, except that a rectangular annular portion 141 in the form of a horizontal flat plate has a rectangular (for example, square) center space 141*a*. Because the bobbin 14 does not have circular, annular, outer surfaces around which a Z-axis coil is wound, the Z-axis coil is wound around the circular peripheral surfaces 136*a*, 136*b*, 136*c*, 136*d* of the fan-shaped projections 132*a*, 132*b*, 132*c*, 132*d* of the second core member 13.

Figure 14A:
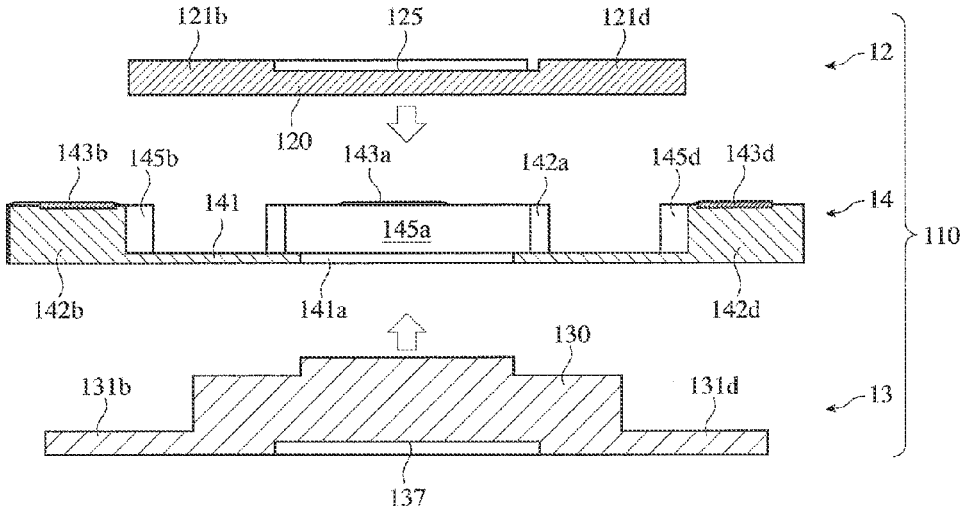
FIG. 14(*a*) is an exploded cross-sectional view taken along the line C-C in FIG. 9(*b*).
Figure 14B:
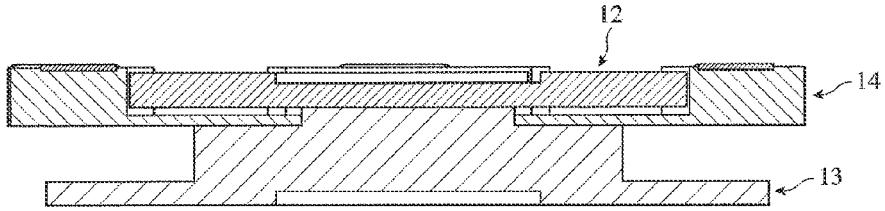
Figure 14C:
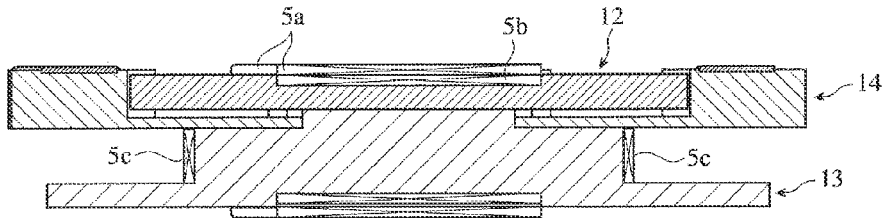
Figure 15A:
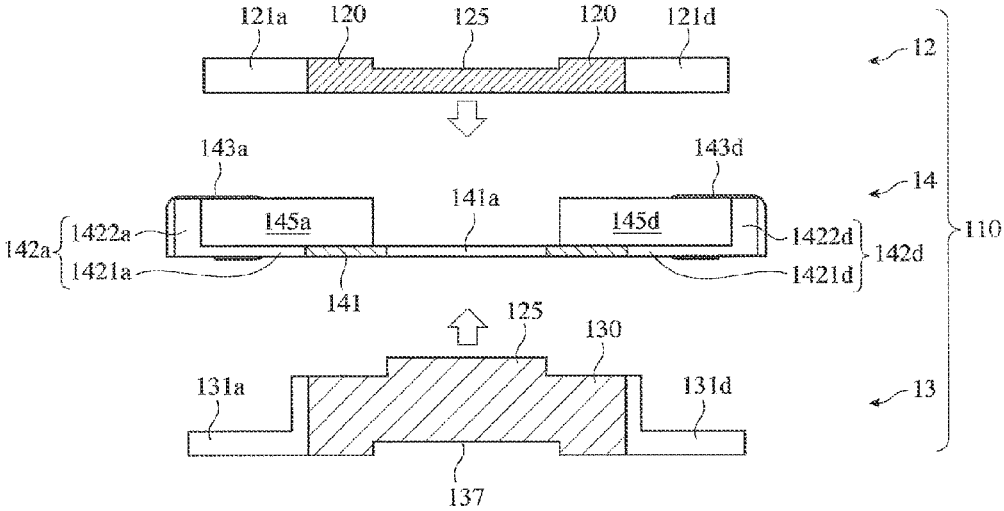
FIG. 15(*a*) is an exploded cross-sectional view taken along the line D-D in FIG. 9(*b*).
Figure 15B:
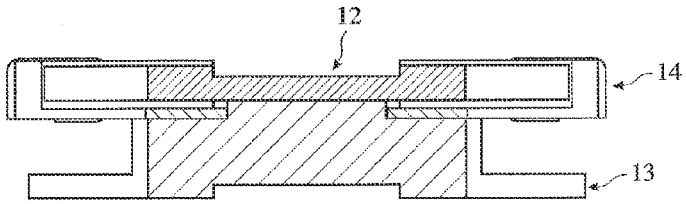
Figure 15C:
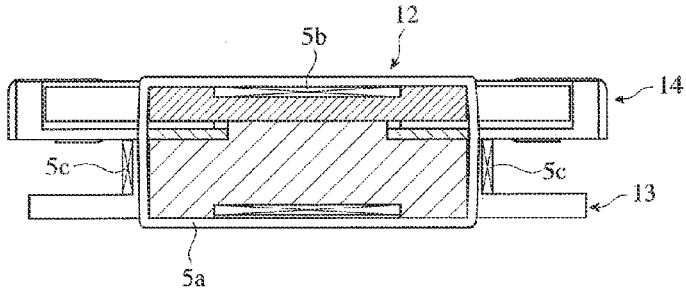

As shown in FIGS. 14(*a*), 14(*b*), 15(*a*) and 15(*b*), because a diameter of a circular contour defined by the fan-shaped flanges 121*a*, 121*b*, 121*c*, 121*d* of the first core member 12 is slightly smaller than the diameter of the circular inner surfaces 145*a*, 145*b*, 145*c*, 145*d* of the projection bodies 1422*a*, 1422*b*, 1422*c*, 1422*d* of the bobbin 14, the first core member 12 is disposed on the horizontal, rectangular, annular portion 141 and fan-shaped, flat portions 1421*a*, 1421*b*, 1421*c*, 1421*d* of the bobbin 14, with a small gap between it and the circular inner surfaces 145*a*, 145*b*, 145*c*, 145*d*.

As shown in FIGS. 14(*a*), 14(*b*), 15(*a*) and 15(*b*), because a flat rectangular projection 135 on an upper surface of the rectangular body 130 of the second core member 13 is slightly smaller than the inner surfaces of the rectangular center space 141*a* defined by the horizontal, rectangular, annular portion 141 of the bobbin 14, the rectangular projection 135 of the second core member 13 is received in the rectangular space 141*a* of the bobbin 14 with a small gap. Because the height of the rectangular projection 135 is substantially equal to the thickness of the horizontal, rectangular, annular portion 141 of the bobbin 14, an upper surface of the rectangular projection 135 of the second core member 13 and an upper surface of the horizontal, rectangular, annular portion 141 of the bobbin 14 are positioned substantially on the same plane, with direct contact with the bottom surface of the first core member 12. Because the horizontal, rectangular, annular portion 141 is sandwiched by portions other than the rectangular projection 135 among the rectangular body 130 of the second core member 13 and the first core member 12, the horizontal, rectangular, annular portion 141 is preferably as thin as possible. The thickness of the horizontal, rectangular, annular portion 141 is preferably 1 mm or less.

Because a rectangular contour defined by the rectangular flanges 131*a*, 131*b*, 131*c*, 131*d* of the second core member 13 is substantially the same as a rectangular contour defined by the rectangular projection 142*a*, 142*b*, 142*c*, 142*d* of the bobbin 14, the second core member 13 overlaps the bobbin 14 substantially completely in a Z direction. The first core member 12 received in the bobbin 14 with a small gap between it and the circular inner surfaces 145*a*, 145*b*, 145*c*, 145*d* is disposed inside the second core member 13 on an X-Y plane. Accordingly, the combination of the first and second core members 12, 13 from both surfaces of the bobbin 14 provides a substantially rectangular core assembly 110. Terminal members 143*a*, 143*b*, 143*c*, 143*d* provided on the rectangular projections 142*a*, 142*b*, 142*c*, 142*d* of the bobbin 14 are positioned inside the rectangular contour of the core assembly 110.

Because the core assembly 110 has recesses in X and Y directions on its sides as shown in FIG. 9, an X-axis coil is wound around a pair of recesses facing the side surfaces 122*a*, 122*b* of the first core member 12 and the side surfaces 134*a*, 134*b* of the second core member 13, and a Y-axis coil is wound around a pair of recesses facing the side surfaces 123*a*, 123*b* of the first core member 12 and the side surfaces 135*a*, 135*b* of the second core member 13. A Z-axis coil is wound around the circular peripheral surfaces 136*a*, 136*b*, 136*c*, 136*d* of the second core member 13. The Y-axis coil can be easily positioned by the groove 125 on an upper surface of the first core member 12. Because the circular peripheral surfaces 136*a*, 136*b*, 136*c*, 136*d* of the second core member 13 are positioned outside the side surfaces 122*a*, 122*b*, 123*a*, 123*b* of the first core member 12 and the side surfaces 134*a*, 134*b*, 135*a*, 135*b* of the second core member 13, around which the X-axis coil and the Y-axis coil are wound, the Z-axis coil can be easily wound around the circular peripheral surfaces 136*a*, 136*b*, 136*c*, 136*d* without contact with the X-axis coil and the Y-axis coil which are already wound. The core assembly 110 around which the X-axis coil, the Y-axis coil and the Z-axis coil are wound is shown in FIGS. 14(*c*) and 15(*c*).

[3] Third Embodiment

Figure 16A:
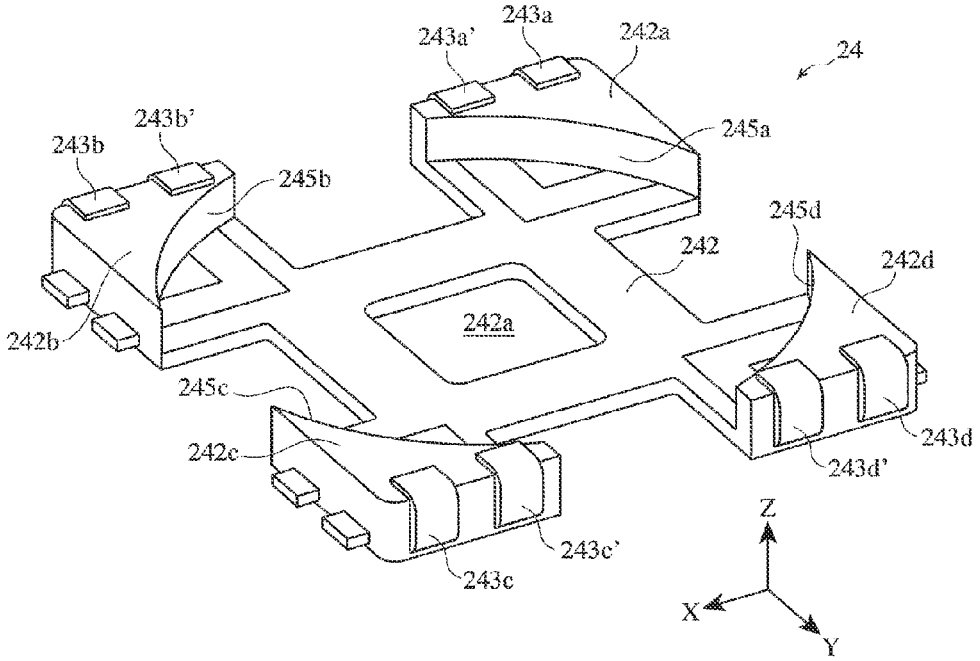
FIG. 16(*a*) is a perspective view showing a bobbin according to the third embodiment of the present invention.
Figure 16B:
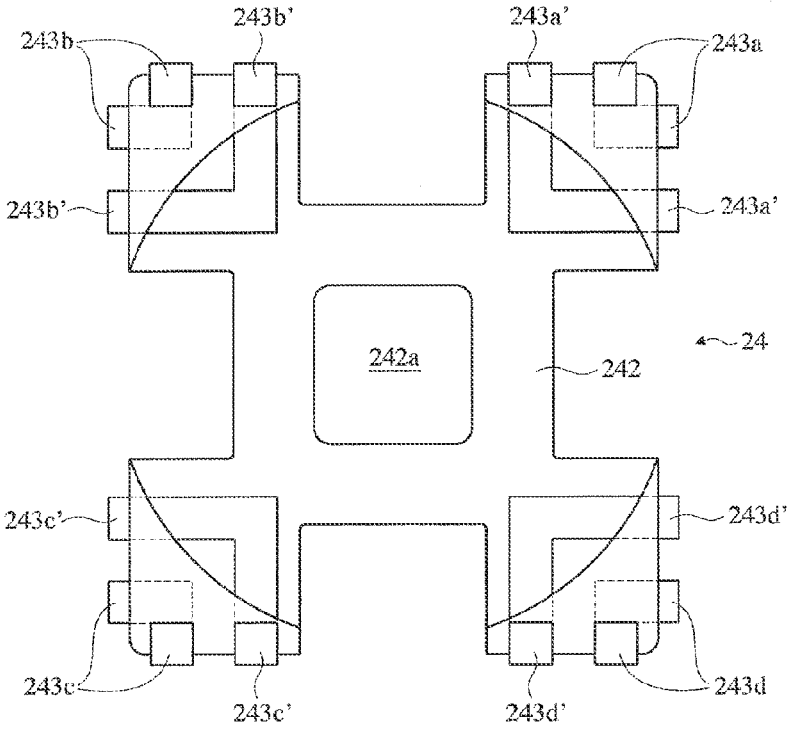
Figure 16C:
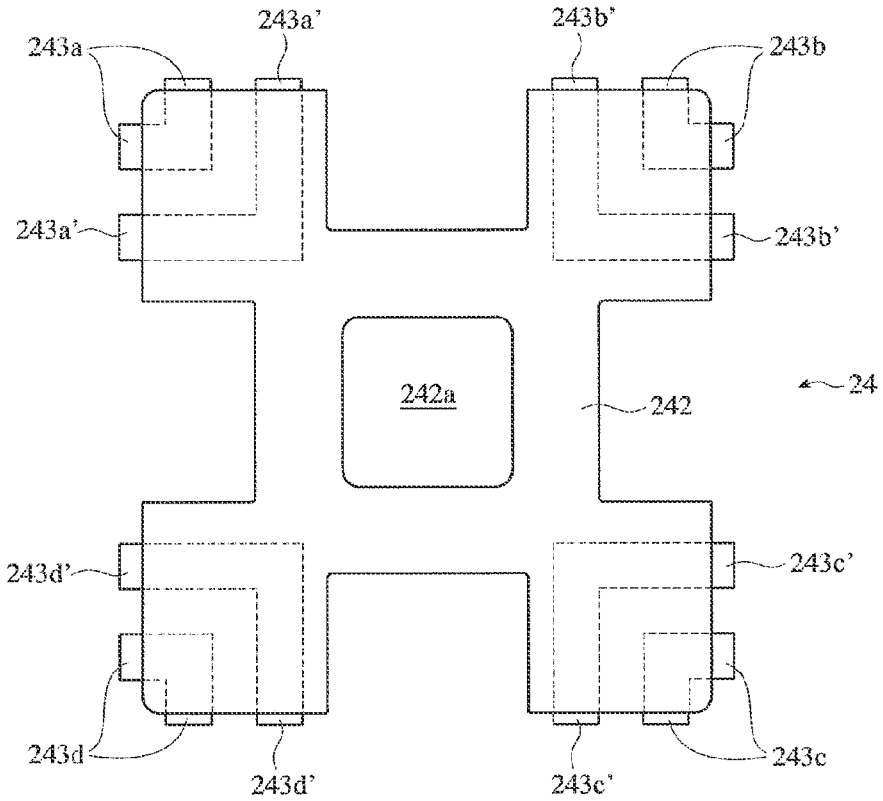

As shown in FIGS. 16(*a*)-16(*c*), a bobbin 24 in this embodiment is substantially the same as the bobbin 14 in the second embodiment, except that each rectangular projection 242*a*, 242*b*, 242*c*, 242*d* has two terminal members 243*a* and 243*a*', 243*b* and 243*b*', 243*c* and 243*c*', 243*d* and 243*d*', eight terminal members in total. For example, one end of an X-axis coil is connected to 243*a*, and the other end thereof is connected to 243*a*'. One end of a Y-axis coil is connected to 243*b*, and the other end thereof is connected to 243*b*'. One end of a Z-axis coil is connected to 243*c*, and the other end thereof is connected to 243*c*'. Remaining terminal members 243*d*, 243*d*' are dummy terminals, which increase the number of connections to electrodes on a circuit board, making the three-axis antenna less detachable from the circuit board.

Because the three-axis antenna of the present invention described above comprises a second core member having a substantially rectangular (for example, square) contour, the flanges of the first and second core members expand in an overall space in which the circuit board is disposed, receiving magnetic flux in a wider area than circular antennas, and thus exhibiting higher receiving sensitivity.

The first and second core members are generally made of a magnetic material, which may be sintered ferrite, or resin press-moldings of powders of soft magnetic materials such as Fe-based, amorphous alloys, Co-based, amorphous alloys, Fe-based or Co-based, nano-crystalline alloys having average crystal grain sizes of 50 nm or less, etc.

[4] Three-Axis Antenna Device

Figure 17:
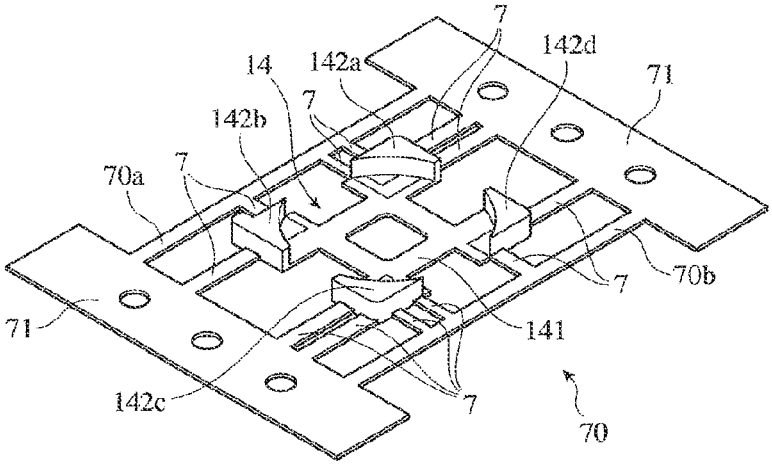
FIG. 17 is a perspective view showing a bobbin integrally molded with a frame to produce a three-axis antenna device.
Figure 18A:
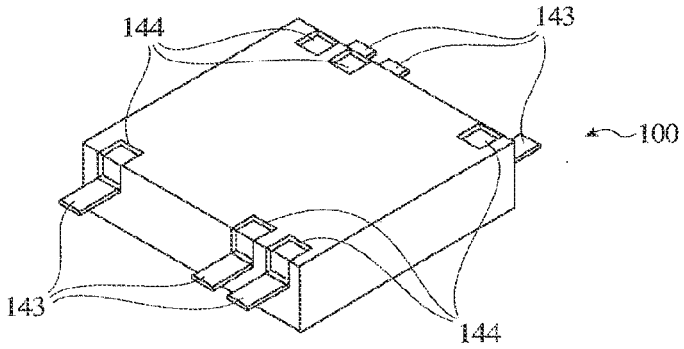
FIG. 18(*a*) is a perspective view showing a three-axis antenna device before terminal members are bent.
Figure 18B:
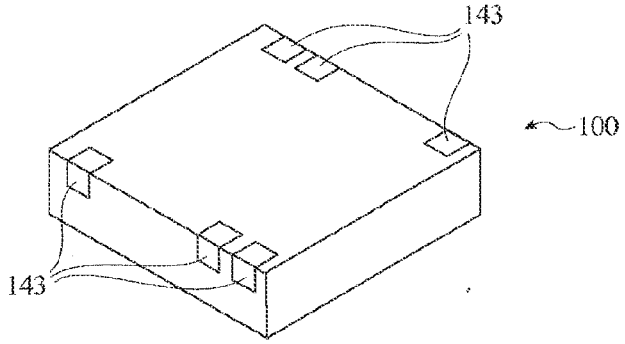

The three-axis antenna of the present invention is preferably molded with a resin as a three-axis antenna device. FIGS. 17 and 18 show one example of steps of resin-molding the same three-axis antenna as in the second embodiment except that the number of terminal members is changed to 6. As shown in FIG. 17, a bobbin 14 comprising a horizontal, rectangular, annular portion 141 and rectangular projections 142*a*, 142*b*, 142*c*, 142*d* is integrally resin-molded with a metal frame 70 comprising frame portions 7 forming terminal members 143. The frame 70 is formed, for example, by punching a 0.2-mm-thick, soft magnetic phosphor bronze plate coated with a primary copper plating layer and then with a tin electroplating layer. The frame 70 is integrally provided on two opposing sides with rectangular frames 71, 71 having pluralities of positioning holes.

After the horizontal, rectangular, annular portion 141 is coated with an adhesive, the first and second core members 12, 13 shown in FIG. 10 are bonded to the horizontal, rectangular, annular portion 141 from both sides. The frame 70 is cut such that portions of the terminal members 143 each to be connected to an end of each coil are bent and then project 0.3 mm from two opposing Y-direction sides of the bobbin 14, and that the other portions of the terminal members 143 project 2.6 mm from two opposing X-direction sides. The X-axis coil, the Y-axis coil and the Z-axis coil are then wound, and each coil end is connected to the terminal member 143 to provide the three-axis antenna.

With this three-axis antenna placed in a molding die, the bobbin 14 and the first and second core members 12, 13 can be integrally molded with a resin to provide a three-axis antenna device 100 shown in FIG. 18(*a*), in which part of terminal members 7 project in an X direction. The three-axis antenna device 100 has recesses 144 for receiving the terminal members 143. Projecting portions of the terminal member 143 are bent to the recesses 144 of the three-axis antenna device 100 as shown in FIG. 18(*b*), to provide a three-axis antenna device 100 in a rectangular parallelepiped shape. This resin-molded, three-axis antenna device 100 has a size of, for example, 11 mm×11 mm×3.5 mm.

After conducting a test of freely falling this three-axis antenna device 100 from a height of 5 m to a concrete surface 100 times, coil ends were not detached from the terminal members 143, and no change in the inductance of each coil was observed.

[5] Receiving Circuit

Figure 19:
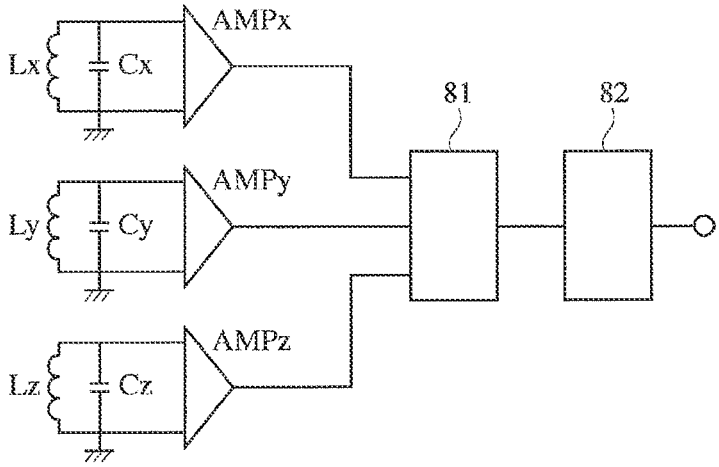
FIG. 19 is a view showing a receiving circuit using the three-axis antenna.

FIG. 19 shows one example of receiving circuits used in the three-axis antenna of the present invention. For simplicity, all coil ends are connected to different terminal members in the depicted example. Of course, several terminal members may be used as common terminals.

Each of an X-axis coil Lx, a Y-axis coil Ly and a Z-axis coil Lz in the three-axis antenna is parallel-connected to a capacitor Cx, Cy, Cz, one end of which is connected to a ground GND. Acting with a parallel-connected capacitor, voltage generated in each coil by magnetic flux is resonated at a desired frequency, generating voltage as large as Q times (Q is a characteristic value of the resonance circuit) at both coil ends. This voltage is amplified by each amplifying circuit AMPx, AMPy, AMPz, and input to a switch circuit 81. The switch circuit 81 comprises a detector (not shown), which outputs the maximum signal selected from signals input from the amplifying circuits AMPx, AMPy, AMPz to a conversion circuit 82. The conversion circuit 82 comprises an envelope detector (not shown) for input signals, and a digital converter for converting input signals to digital signals with a predetermined voltage threshold. Because of such structure, high receiving sensitivity is always obtained in whichever direction the three-axis antenna receives signals.

The present invention will be explained in further detail by Examples below, without intention of restricting the present invention thereto.

Example 1 and Comparative Example 1

Figure 20:
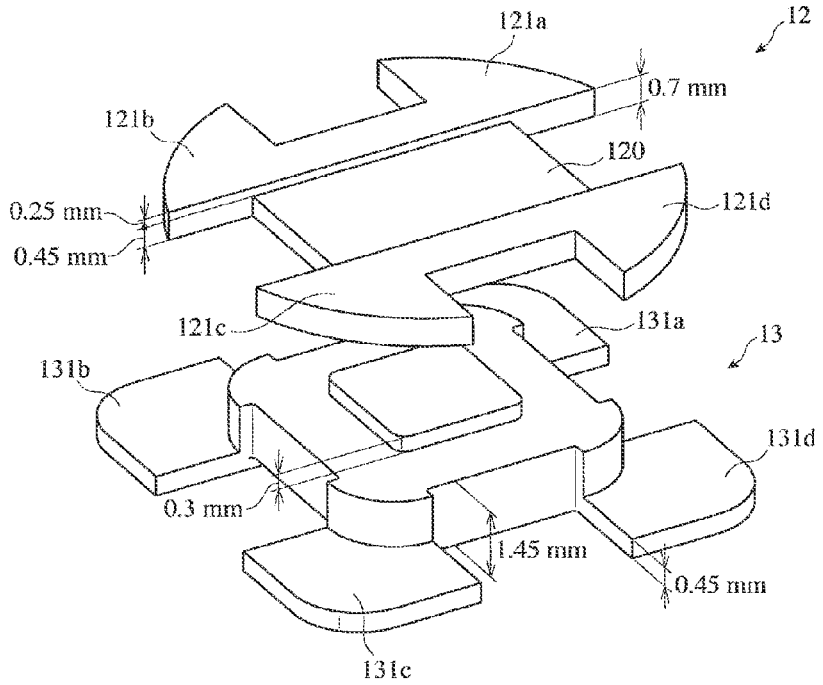
FIG. 20 is a perspective view showing the sizes of the first and second core members in Example 1.
Figure 21:
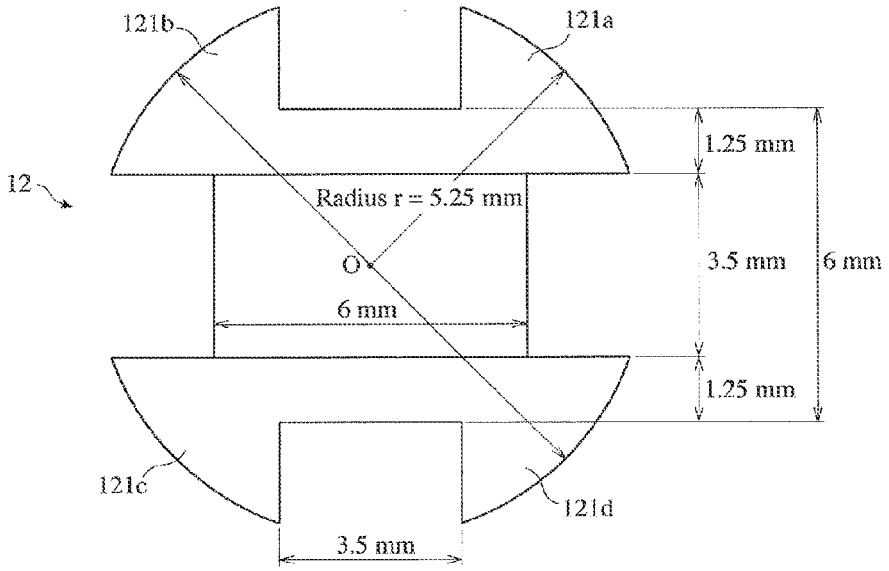
FIG. 21 is a plan view showing the size of the first core member in Example 1.
Figure 22A:
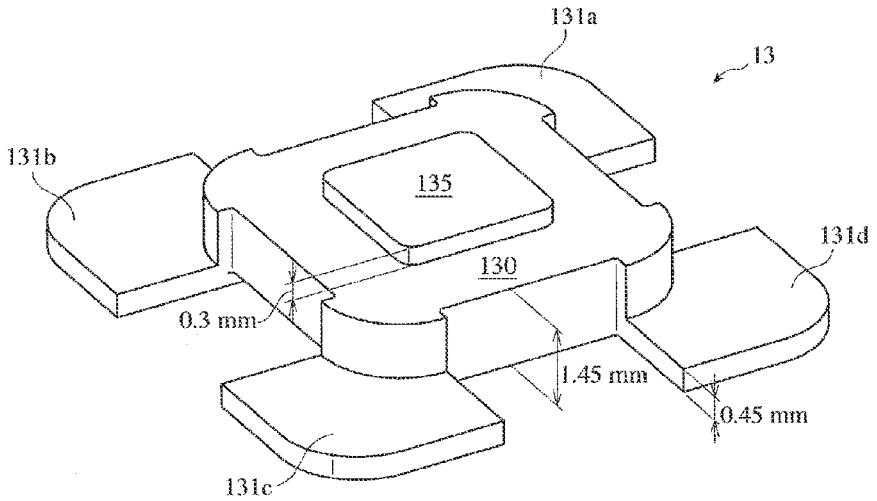
FIG. 22(*a*) is a perspective view showing the size of the second core member in Example 1.
Figure 22B:
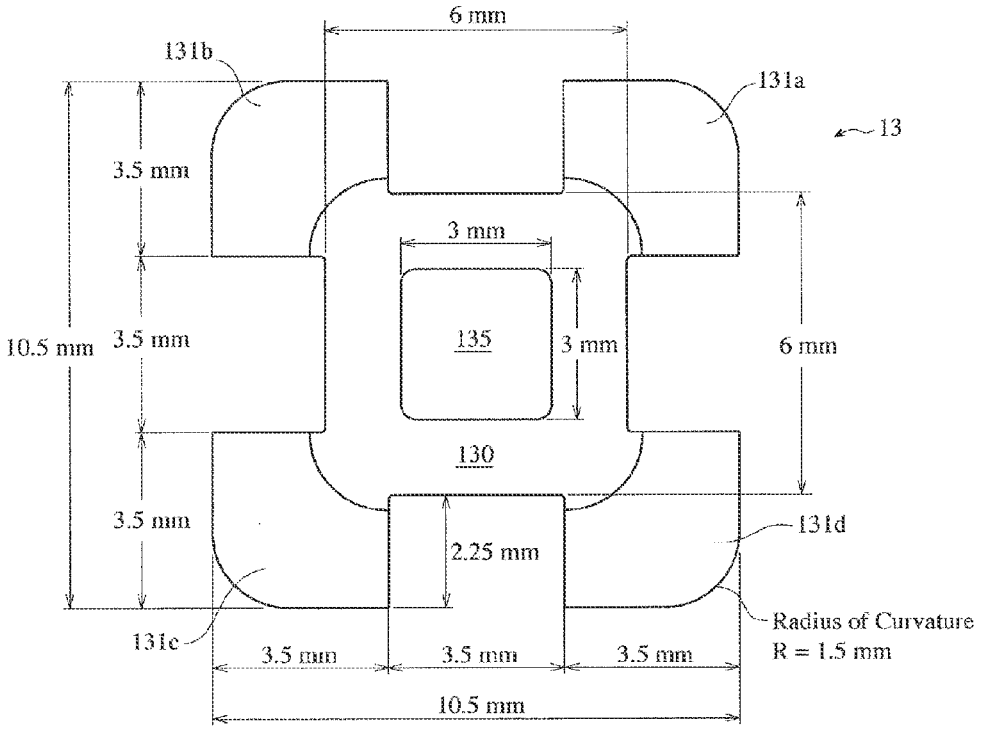

To produce a three-axis antenna in the second embodiment, first and second core members 12, 13 were produced by press-molding Ni—Zn ferrite (ND50S available from Hitachi Metals Ltd.). The size of each part of the first and second core members 12, 13 is shown in FIGS. 20-22. Each flange 131*a*, 131*b*, 131*c*, 131*d* of the second core member 13 is in a square shape having a round corners (radius of curvature R=1.5 mm)

Figure 23A:
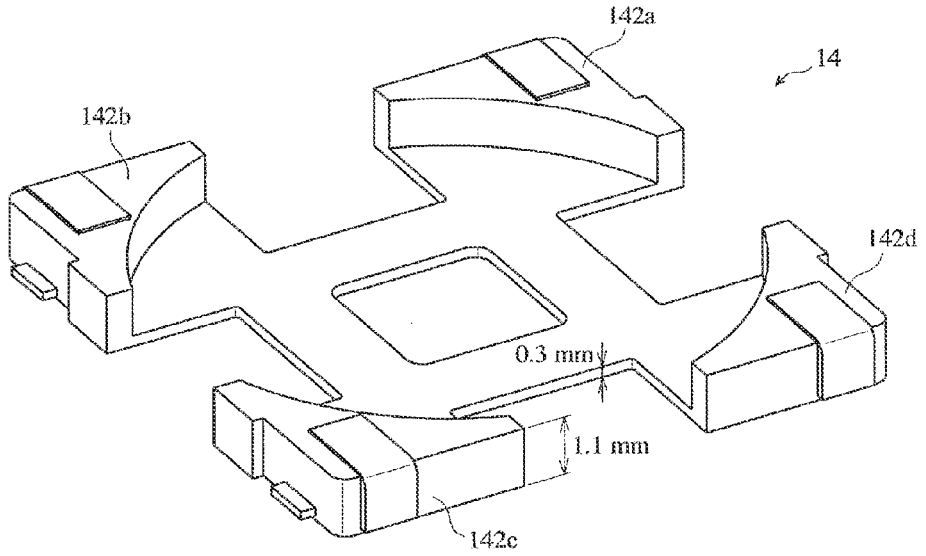
FIG. 23(*a*) is a perspective view showing the size of the bobbin in Example 1.
Figure 23B:
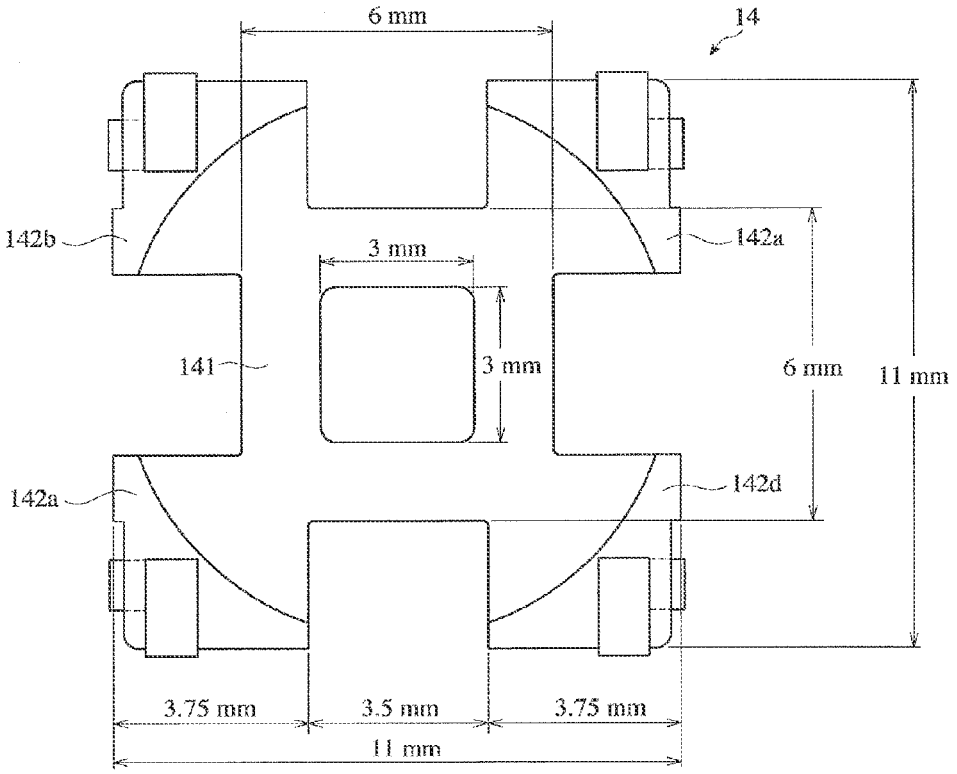
Figure 24A:
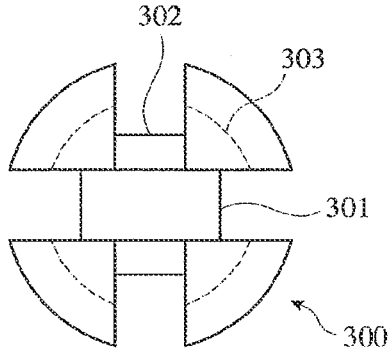
FIG. 24(*a*) is a front view showing a core used in a three-axis antenna disclosed in JP 2004-015168 A.
Figure 24B:
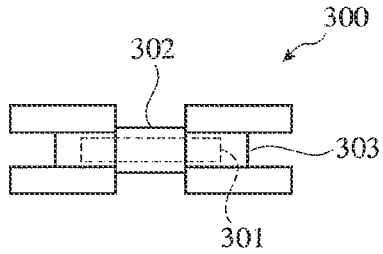
Figure 24C:
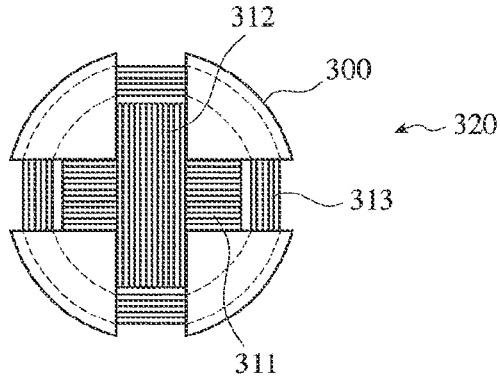
Figure 24D:
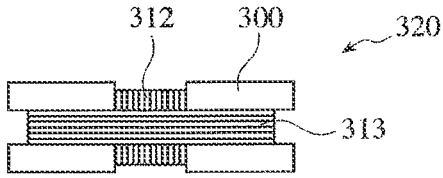
Figure 24E:
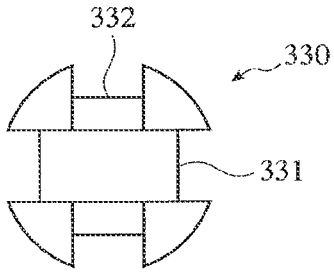
Figure 24F:
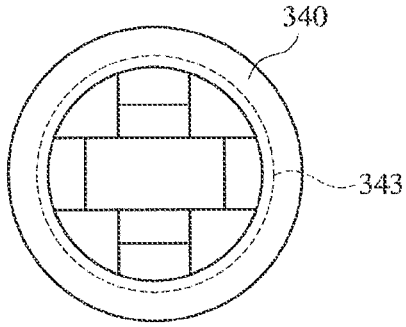
Figure 25:
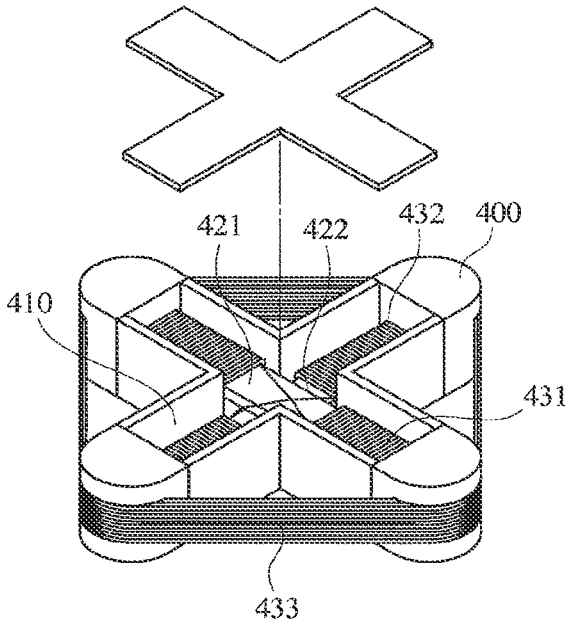
FIG. 25 is a perspective view showing a three-axis antenna disclosed in JP 2007-151154 A.

A bobbin 14 was integrally formed by injection-molding terminal members 143*a*, 143*b*, 143*c*, 143*d* with a fully-aromatic polyester resin (SUMIKASUPER LCP E4008 available from Sumitomo Chemical Co., Ltd.). The terminal members 143*a*, 143*b*, 143*c*, 143*d* were formed by phosphor bronze, with their ends projecting from the side surfaces of the bobbin 14. The size of each part of the bobbin 4 is shown in FIG. 23.

A 0.035-mm-thick, enameled copper wire was wound around the core assembly by 380 turns (two-part winding) to form an X-axis coil and a Y-axis coil, and a 0.04-mm-thick, enameled copper wire was wound around the core assembly by 500 turns to form a Z-axis coil. The resultant three-axis antenna was as small as 11 mm×11 mm and 3.5 mm in thickness (height), and as light as about 1.0 g.

Antenna sensitivity was measured in a range of 129-139 kHz on the three-axis antenna of Example 1, and the three-axis antenna (Comparative Example 1) of JP 2004-015168 A shown in FIGS. 24(*a*) to 24(*d*), which had substantially the same projected area as that of the three-axis antenna of Example 1 in a Z direction. The maximum antenna sensitivity in this frequency range was regarded as the antenna sensitivity. The results are shown in Table 1. As is clear from Table 1, the three-axis antenna of Example 1 had higher sensitivity than that of the three-axis antenna of Comparative Example 1 in all of the X direction, the Y direction and the Z direction.

TABLE 1

| | Antenna Sensitivity (mV) | | |
|---|---|---|---|
| No. | X Direction | Y Direction | Z direction |
| Example 1 | 14.6 | 15.7 | 13.0 |
| Comparative Example 1 | 11.9 | 12.3 | 12.9 |

In the three-axis antenna of Example 1, each coil had inductance and antenna characteristic Q as follows: 5.0 mH or more and 22.0 or more (X-axis coil), 5.0 mH or more and 24.0 or more (Y-axis coil), and 6.0 mH or more and 30.0 or more (Z-axis coil). With the number of coil windings providing sufficiently high inductance even if it is small, the three-axis antenna of the present invention has high antenna characteristic Q, and thus can receive only a necessary frequency band.

Effect of the Invention

The three-axis antenna of the present invention comprising a core assembly having a pair of core members combined via a bobbin and three-direction coils wound around the core assembly has high receiving sensitivity even if it is thin and small in an installation area, and can be produced inexpensively because of using press-formable cores. Accordingly, it is suitable for various electronic keys required to be small and thin. The three-axis antenna of the present invention is suitable mainly as a receiving antenna operable at 300 kHz or less. The three-axis antenna of the present invention having such features can be used for electronic authentication keys for opening and closing keys of automobiles and houses, radiowave watches capable of adjusting time by receiving magnetic field components in electromagnetic waves containing time information, RFID tag systems transmitting and receiving information by modulation signals carried by electromagnetic waves, etc.

Further, for example, in the case of an antenna capable of charging and transmitting by radiowaves from automobiles in keyless entry systems of automobiles, different-sized flanges in the first and second core members make it easy to transmit radiowaves to a smaller flange, so that the antenna can be used as a transmitting/receiving antenna.

What is claimed is:

1. A core assembly for a three-axis antenna comprising a first core member comprising a body around which an X-axis coil and a Y-axis coil are wound, and flanges integrally and diagonally extending from said body;

a second core member comprising a body around which an X-axis coil and a Y-axis coil are wound, and flanges integrally and diagonally extending from said body; and a bobbin comprising an annular portion and projections integrally and diagonally extending therefrom;

the projections of said bobbin being provided with terminal members connected to the ends of the X-axis coil, the Y-axis coil and the Z-axis coil;

the annular portion of said bobbin functioning as a space for disposing said first core member from one side, and receiving at least part of the body of said second core member from the other side, such that the body of said first core member and the body of said second core member are at least partially adjacent to each other; and a space for winding the Z-axis coil being provided between the projections of said bobbin and the flanges of said first or second core member.

2. The core assembly according to claim 1, wherein said first core member is in the form of a flat plate, and said second core member has a thicker body than flanges.

3. The core assembly according to claim 1, wherein said terminal members provided on the projections of said bobbin are positioned such that they do not overlap said X-axis coil and said Y-axis coil in a Z direction.

4. The core assembly according to claim 1, wherein said first core member is in the form of a thin flat plate having a rectangular body and flanges integrally and diagonally extending from said body;

wherein said second core member has a thicker rectangular body than said first core member, and thin rectangular flanges integrally and diagonally extending from said body; and wherein said bobbin comprises an annular portion which is rectangular at least in a center portion, and rectangular projections integrally and diagonally extending from corners of said annular portion.

5. The core assembly according to claim 4, wherein the rectangular center portion of the annular portion of said bobbin is in the form of a perpendicularly extending thin flat plate such that it provides a space for receiving the entire rectangular body of said second core member, whereby said X-axis coil and said Y-axis coil are wound around the rectangular body of said first core member and the annular portion of said bobbin, and said Z-axis coil is wound around the annular portion of said bobbin between the rectangular projections of said bobbin and the rectangular flanges of said second core member.

6. The core assembly according to claim 4, wherein the rectangular body of said second core member is partially provided with a flat projection, and the rectangular center portion of the annular portion of said bobbin is in the form of a horizontally extending thin flat plate such that it provides a space for receiving the flat projection of the rectangular body of said second core member, whereby said X-axis coil and said Y-axis coil are wound around the rectangular body of said first core member and the rectangular body of said second core member, and said Z-axis coil is wound around the rectangular body of said second core member between the rectangular projections of said bobbin and the rectangular flanges of said second core member.

7. The core assembly according to claim 6, wherein the rectangular body of said second core member is provided at corners with fan-shaped projections overlapping part of said rectangular flanges, and wherein said Z-axis coil is wound around the fan-shaped projections of said second core member.

8. The core assembly according to claim 4, wherein the rectangular flanges of said second core member and the rectangular projections of said bobbin constitute a rectangular contour.

9. A three-axis antenna comprising the core assembly recited in claim 1, and an X-axis coil, a Y-axis coil and a Z-axis coil wound around said core assembly, each coil end being connected to each of said terminal members.

* * * * *